US007876914B2

(12) United States Patent
Grosvenor et al.

(10) Patent No.: US 7,876,914 B2
(45) Date of Patent: Jan. 25, 2011

(54) PROCESSING AUDIO DATA

(75) Inventors: David Arthur Grosvenor, Frampton Cotterell (GB); Guy de Warrenne Bruce Adams, Stroud (GB)

(73) Assignee: Hewlett-Packard Development Company, L.P., Houston, TX (US)

( * ) Notice: Subject to any disclaimer, the term of this patent is extended or adjusted under 35 U.S.C. 154(b) by 1647 days.

(21) Appl. No.: 11/135,556

(22) Filed: May 23, 2005

(65) Prior Publication Data

US 2005/0281410 A1 Dec. 22, 2005

(30) Foreign Application Priority Data

May 21, 2004 (GB) ..... 0411297.5

(51) Int. Cl.
*H04R 3/00* (2006.01)
*H04R 29/00* (2006.01)

(52) U.S. Cl. ..... 381/92; 381/56; 381/122

(58) Field of Classification Search ..... 381/56, 381/58, 61, 77, 122, 310, 26, 92, 95; 345/418
See application file for complete search history.

(56) References Cited

U.S. PATENT DOCUMENTS

| | | | | |
|---|---|---|---|---|
| 3,665,105 | A | 5/1972 | Chowning | |
| 5,477,270 | A | 12/1995 | Park | |
| 5,544,249 | A | 8/1996 | Opitz | |
| 5,682,433 | A | 10/1997 | Pickard et al. | |
| 6,188,769 | B1 | 2/2001 | Jot et al. | |
| 6,757,394 | B2 * | 6/2004 | Matsuo | 381/92 |
| 6,904,152 | B1 * | 6/2005 | Moorer | 381/18 |
| 7,095,860 | B1 * | 8/2006 | Kemp | 381/61 |
| 2002/0064287 | A1 | 5/2002 | Kawamura et al. | |
| 2002/0075295 | A1 | 6/2002 | Stentz et al. | |
| 2002/0109680 | A1 * | 8/2002 | Orbanes et al. | 345/418 |
| 2002/0150263 | A1 | 10/2002 | Rajan | |
| 2003/0179890 | A1 * | 9/2003 | Matsuo | 381/92 |
| 2004/0076301 | A1 * | 4/2004 | Algazi et al. | 381/17 |
| 2004/0246199 | A1 | 12/2004 | Ramian | |

FOREIGN PATENT DOCUMENTS

| | | | |
|---|---|---|---|
| EP | 0615387 | A1 | 8/1993 |
| WO | WO 03/03269 | A1 | 1/2003 |

OTHER PUBLICATIONS

GB Search Report dated Dec. 30, 2004.

* cited by examiner

*Primary Examiner*—Vivian Chin
*Assistant Examiner*—George Monikang

(57) ABSTRACT

An exemplary embodiment is a method of processing audio data comprising: characterising an audio data representative of a recorded sound scene into a set of sound sources occupying positions within a time and space reference frame; analysing the sound sources; and generating a modified audio data representing sound captured from at least one virtual microphone configured for moving about the recorded sound scene, wherein the virtual microphone is controlled in accordance with a result of the analysis of said audio data, to conduct a virtual tour of the recorded sound scene.

68 Claims, 20 Drawing Sheets

PROCESSING AUDIO DATA

TECHNICAL FIELD

The present invention relates to a method and apparatus for processing audio data.

CLAIM TO PRIORITY

This application claims priority to copending United Kingdom utility application entitled, "PROCESSING AUDIO DATA," having serial no. GB 0411297.5, filed Apr. 21, 2004, which is entirely incorporated herein by reference.

BACKGROUND

Audio data representing recordings of sound associated with physical environments are increasingly being stored in digital form, for example in computer memories. This is partly due to the increase in use of desktop computers, digital sound recording equipment and digital camera equipment. One of the main advantages of providing audio and/or image data in digital form is that it can be edited on a computer and output to an appropriate data output device so as to be played. Increasingly common is the use of personal sound capture devices that comprise an array of microphones to record a sound scene, which a given person is interested in recording. The well known camcorder type device is configured to record visual images associated with a given environmental scene and these devices may be used in conjunction with an integral personal sound capture device so as to create a visual and audiological recording of a given environmental scene. Frequently such camcorder type devices are used so that the resultant, image and sound recordings are played back at a later date to colleagues of, or friends and family of, an operator of the device. Camcorder type devices may frequently be operated to record one or more of: sound only, static images or video (moving) images. With advances in technology sound capture systems that capture spatial sound are also becoming increasingly common. By spatial sound system it is meant, in broad terms, a sound capture system that conveys some information concerning the location of perceived sound in addition to the mere presence of the sound itself. The environment in respect of which such a system records sound may be termed a "soundscape" (or a "sound scene" or "sound field") and a given soundscape may comprise one or a plurality of sounds. The complexity of the sound scene may vary considerably depending upon the particular environment in which the sound capture device is located within. A further source of sound and/or image data is sound and image data produced in the virtual world by a suitably configured computer program. Sound and/or image sequences that have been computer generated may comprise spatial sound.

Owing to the fact that such audio and/or image data is increasingly being obtained by a variety of people there is a need to provide improved methods and systems for manipulating the data obtained. An example of a system that provides motion picture generation from a static digital image is that disclosed in European patent publication no. EP 1235182, incorporated herein by reference, and in the name of Hewlett-Packard Company. Such a system concerns improved digital images so as to inherently hold the viewer's attention for a longer period of time and the method as described therein provides for desktop type software implementations of "rostrum camera" techniques. A conventional rostrum camera is a film or television camera mounted vertically on a fixed or adjustable column, typically used for shooting graphics or animation—these techniques for producing moving images are the type that can typically be obtained from such a camera. The system described in EP 1235182 provides zooming and panning across static digital images.

SUMMARY

According to an exemplary embodiment, there is provided a method of processing audio data comprising: characterising an audio data representative of a recorded sound scene into a set of sound sources occupying positions within a time and space reference frame; analysing the sound sources; and generating a modified audio data representing sound captured from at least one virtual microphone configured for moving about the recorded sound scene, wherein the virtual microphone is controlled in accordance with a result of the analysis of said audio data, to conduct a virtual tour of the recorded sound scene.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which:

FIG. 9 further details types of people sounds that a virtual microphone as configured by application program 201 may be responsive to and controlled by;

FIG. 10 further details types of mechanical sounds that a virtual microphone as configured by application program 201 may be responsive to;

FIG. 11 further details types of environmental sounds that a virtual microphone as configured by application program 201 may be responsive to;

FIG. 12 further details types of animal sounds that a virtual microphone as configured by application program 201 may be responsive to;

FIG. 13 further details types of place sounds that a virtual microphone as configured by application program 201 may be responsive to;

DETAILED DESCRIPTION

Figure 1:
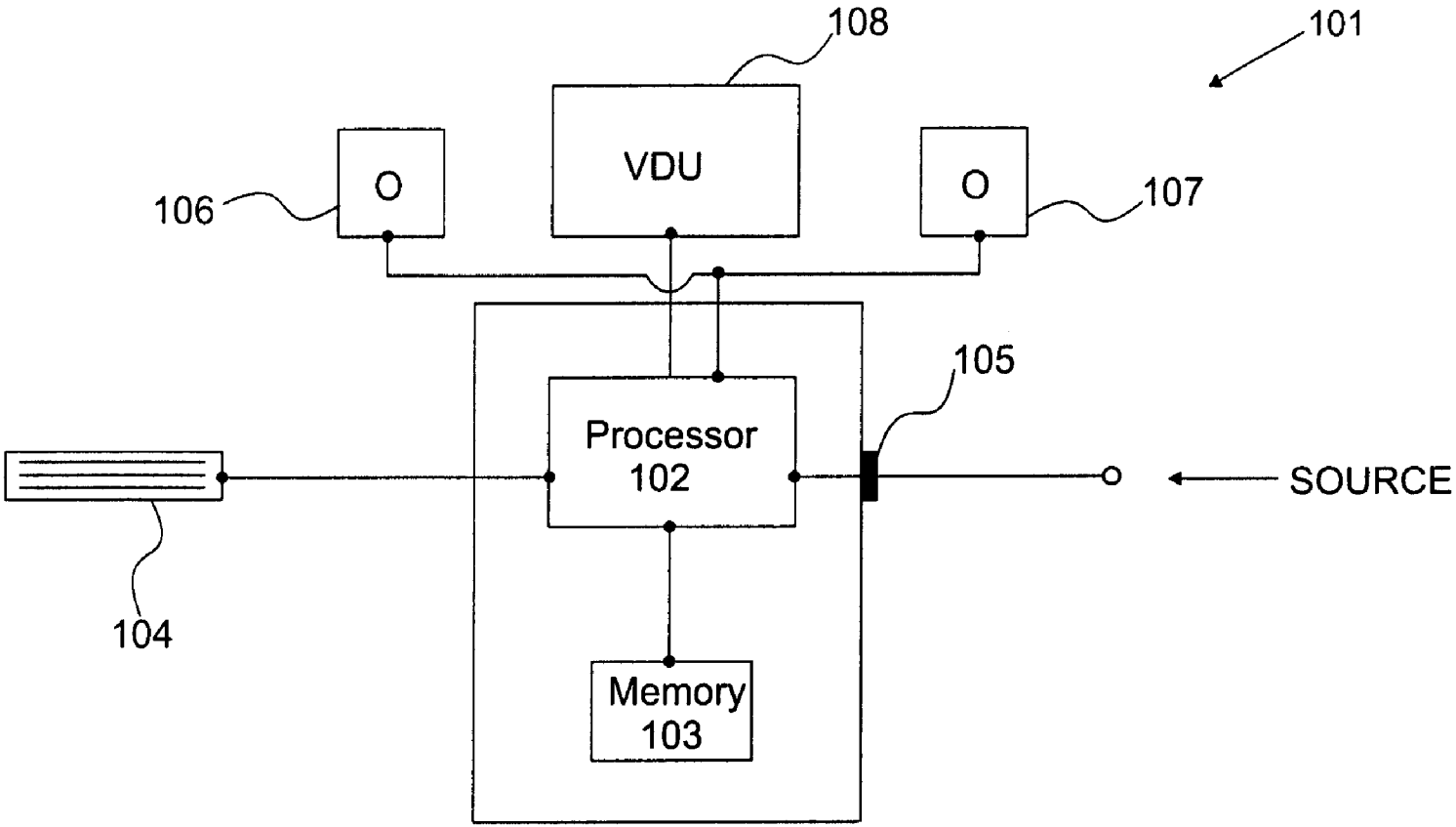
FIG. 1 schematically illustrates a computer system for running a computer program, in the form of an application program.

There will now be described by way of example a specific mode contemplated by the inventors. In the following description numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description.

Overview

A soundscape comprises a multi dimensional environment in which different sounds occur at various times and positions. Specific embodiments and methods herein provide a system for navigating a such a soundscape. An example of a soundscape may be a crowded room, a restaurant, a summer meadow, a woodland scene, a busy street or any indoor or out door environment where sound occurs at different positions and times. Soundscapes can be recorded as audio data, using directional microphone arrays or other like means.

Specific embodiments and methods herein may provide a post processing facility for a soundscape which is capable of navigating a stored soundscape data so as to provide a virtual tour of the soundscape. This is analogous to a person with a microphone navigating the environment at the time at which the soundscape was captured, but can be carried out retrospectively and virtually using the embodiments and methods disclosed herein.

Within the soundscape, a virtual microphone is able to navigate, automatically identifying and investigating individual sounds sources, for example, conversations of persons, monologues, sounds produced by machinery or equipment, animals, activities, natural or artificially generated noises, and following sounds which are of interest to a human user. The virtual microphone may have properties and functionality analogous to those of a human sound recording engineer of the type known for television or radio programme production, including the ability to identify, seek out and follow interesting sounds, home in on those sounds, zoom in or out from those sounds, pan the environment in general landscape "views" across the soundscape. The virtual microphone provides a virtual mobile audio rostrum, capable of moving around within the virtual sound environment (the soundscape), in a similar manner to how a human sound recording engineer may move around within a real environment, holding a sound recording apparatus.

A 3D spatial location of sound sources is determined, and preferably also, acoustic properties of the environment. This defines a sound scene allowing a virtual microphone to be placed anywhere within it, adjusting the sounds according to the acoustic environment, and allows a user to explore a soundscape.

This spatial audio allows camera-like-operations to be defined for the virtual microphone as follows:

An audio zoom function is analogous to a camera zoom which determines a field of "view" that selects part of the scene. The audio zoom may determine which sound sources are to be used by their spatial relation to a microphone, for example within a cone about a 3D point of origin at the microphone;

An audio focus is analogous to a camera focus. This is akin to placing the microphone closer to particular sound sources to they appear louder; and A panning (rotating) function and a translating function are respectively analogous to their camera counterparts for panning (rotating) or translating the camera. This is analogous to selecting different sound sources in particular spatial relation.

The existence of these camera-like operations in a soundscape allows the soundscape to be sampled in a similar manner to a rostrum camera moving about a still image. However there are important differences. For example:

Audio has a temporal nature that is somewhat ignored by the analogous operations that exploit the spatial properties of their sources; and A rostrum camera work finds its most compelling use when used in combination with a display which is incapable of using the available resolution in the captured image signal. Part of the value of the rostrum camera is in revealing the extra detail through the inadequate display device. There is no similar analogous between the detail captured and displayed in the audio domain. However there is some benefit derived from zooming—it selects and hence emphasizes particular sound sources as with zooming in on part of an image.

In attempting to apply the known light imaging rostrum camera concept, the temporal nature of sound forces. The concept to be generalized into a "spatial-temporal rostrum camera" concept, better seen as some form of video editing operation for a wearable video stream where the editing selects both spatially and in time. The composed result may jump about in time and space, perhaps showing things happening with no respect for temporal order, that is, showing the future before the past events that caused it. This is common behavior in film directing or editing. Hence the automatic spatial-temporal rostrum camera attempts to perform automatic video editing.

An important feature of the present embodiments and methods is the extra option of selecting in time as well as the ability to move spatial signals into the temporal (e.g. a still into video).

Audio analysis may be applied to the soundscape, to automatically produce a tour of the spatial soundscape which emphasizes and de-emphasizes, omits and selects particular sound sources To do this automatically requires some notion of interesting audio events and "saliency". In accordance with the present preferred embodiment it is useful to detect when a particular sound source would be interesting—this would depend upon the position of the virtual listener. For example, if you are close to a sound source you will not notice the contribution of other sound sources, and the saliency will be dominated by the how much the loudness, texture, etc. . . . of this sound compared to the other sounds within the field of view. There may be provided a signal (a "saliency" signal) indicative of when a particular sound may be of interest to a listener located at a particular position in a given sound scene. As previously stated the sound scene may be associated with an image or image sequence that may itself have been recorded with a particular sound-recording being played saliency of a sound source may be based upon cues from an associated image or images. The images may be still images or moving images. Furthermore the interest-measure provided in respect of sounds is not necessarily solely based on the intensity (loudness) of these sounds. The saliency signal may be based partly on an intensity-measure or may be based on parameters that do not include sound intensity.

A preferred embodiment uses zoom and focus features to select the virtual microphone or listening position and then predicts saliency based upon the auditory saliency at this position relative to particular sound sources.

In a preferred embodiment, auditory saliency is used to recognize particular human speakers, children's voices, laughter and to detect emotion or prosody. By prosody it is meant the manner in which one or more words is/are spoken. Known word recognition techniques are advanced enough such that a large number of words can be accurately recognized. Furthermore the techniques are sufficiently advanced, as those skilled in the art are aware, to recognize voice intensity pattern, lowered or raised voice, or a pattern of variation such as is associated with asking a question, hesitation, the manner in which words are spoken (i.e. the different stresses associated with different words) and to detect particular natural sounds etc. For example, U.S. Pat. No. 5,918,223 (Muscle Fish) discloses a system for the more detailed classification of audio signals by comparison with given sound signals. The system is claimed to be used for multimedia database applications and Internet search engines. Other Muscle Fish patents are known that concern techniques for recognizing particular natural or mechanical sounds. Certain sounds are known to be highly distinctive as is known to those skilled in the art that are familiar with the work of "The World Soundscape Project". Moving sound sources attract attention as well adding a temporal dimension, but after a while people get used to similar sounds and they are deemed less interesting.

The audio data of the soundscape is characterized into sound sources occupying positions within a time-spatial reference frame. There are natural ways of grouping or cropping sound sources based upon their spatial position. There are ways of detecting the natural scope of particular sounds. They provide some way of temporally segmenting the audio. But equally there are temporal ways of relating and hence selecting sound sources in the scene that need not be based upon the spatial grouping or temporal segmentation. The way in which sound sources work in harmony together can be compared using a wide variety of techniques as is known to those skilled in the art. The way in which one sound works in beat or rhythm with others over a period of time suggests that they might well be grouped together i.e. they go together because they would sound nice together. Also declaring sound sources to be independent of other sound sources is a useful facility, as is detecting when a sound source can be used to provide discrete background to other sounds.

An important commercial application may be achieved where a visual tour of a soundscape is synchronized with a visual channel (such as with an audio photograph or with a panoramic audio photograph). The embodiments may be used with the virtual microphone located in a given soundscape, or the audio may be used to drive the visual. Combinations of these two approaches can also be used.

An example would be zooming in on a child when a high resolution video or still image is providing a larger field of view of the whole family group. The sound sources for the whole group are changed to one emphasizing the child, as the visual image is zoomed in A preferred embodiment may synchronize respective tours provided by a virtual audio rostrum and a visual virtual rostrum camera. This would allow the virtual camera to be driven by either or both of the auditory analysis and/or the visual analysis. By "virtual audio rostrum" it is meant, a position which may be a moving position within a recorded soundscape, at which a virtual microphone is present. By the term "visual virtual rostrum camera" it is meant a position within a three dimensional environment, which is also subject of a recorded sound scene, in which a still and/or video camera is positioned, where the position of the camera may be moveable within the environment.

Examples of the styles of producing an audio tour and the forms of analysis appropriate There now follows several examples of how a soundscape comprising audio data may be analysed, the audio data characterized into sound sources, and a virtual microphone may be controlled to navigate the soundscape, controlled by results of the analysis of the sound sources to conduct a virtual tour of the soundscape.

Simultaneous Conversations

In one example of analysing sound sources and controlling a virtual microphone according to those sound sources, here may be supplied spatial sound sources for a restaurant/café/pub. A virtual microphone might focus in on a conversation on one table and leave out the conversation taking place at another table. This allows or directs a human listener to focus on one group. After playing this group of sound sources the virtual microphone or another virtual microphone might then focus in on the conversation on the other table that was taking place at the same time. To do this it is necessary to be sure that the groups of sounds are independent of each other (overlapping speakers that are spatially distributed would be a good indicator). However "showing" background sound sources common to both groups would add to the atmosphere. The background would probably show as lots of diffuse sounds.

Capturing an Atmosphere

In another example, audio data may be analysed, and a virtual microphone used to capture the atmosphere of a place that is crowded with sound sources. Here the one or more virtual microphones would not be configured to try to listen in on conversations, rather they would deliberately break up a speaker talking, deliberately preventing a listener from being distracted by what is a said. Whilst listening to one sound source the other sounds might be removed using the zoom or perhaps de-emphasized and played less loudly. The emphasis could switch to other sound sources in the room, blending smoothly from one sound source to another or perhaps making shaper transitions (such as a cut). The sound sources might be sampled randomly in a temporal fashion or moved about as a virtual audio microphone.

This form of presentation of selecting different sound sources mirrors the way that a human listener's attention to sound works. A person can lock on to one sound source and lock out the effect of other sound sources. The attention of a person can flick around the scene. This provides another (non-geometric) inspiration for the selective focus upon different sound sources in the scene.

The Orchestra

This example envisages an orchestra playing, but it is possible for an expert listener to pick out the contributions of individual instruments. To re-create this for the unskilled listener the spatial distribution of the instruments of a certain type would be used to zoom in on them thereby emphasizing the instruments of interest. This can be seen as moving the virtual microphone amongst this particular block of instruments.

Another alternative would be to detect when the sound sources of the same type of instrument (or perhaps related instruments) occurred.

Bird Songs

Songs of birds of a particular species may be selected disregarding the sounds from other animals.

Parents and Children

Family groups consisting of parents and several children go through phases of interaction with each other and periods where the sound sources are independent. If the parents are watching the children it becomes important to disregard the sound of people nearby and people not from the group. It may be desirable to zoom and focus on the sounds of the children.

A source of spatial sound is required for capture of the soundscape. This may be obtained from a spatial sound capture system on, for example, a wearable camera. Depending upon the application requirements a source of video or a high resolution still image of the same scene may also be required. The system proceeds using image/video processing and audio analysis determining saliency.

An automatic method of synthesizing new content from within the spatial audio of a recorded sound scene, there is an ability spatial audio may be possible using the embodiments and methods herein. to suppress and emphasize particular sound sources. The method selects both spatially and temporally to produce new content. The method can expand simultaneous audio threads in time.

There are two ways in which spatial sound can be used—one is driven by geometrical considerations of the sound scene and explains the tour through geometric movements of the listener, the other is driven by attention and/or aesthetic considerations where the inspiration is of human perception of sounds.

Other aspects of the features include synchronizing visual and audio rostrum camera functionality.

In the case of spatial audio captured from crowded scenes a random like style may be identified for giving the atmosphere of a place. This avoids the need for long audio tracks.

Further there may be provided means of lifting auditory saliency measures into the realms of spatial sound.

There now follows description of a first specific embodiment. Where appropriate, like reference numbers denote similar or the same items in each of the drawings.

Hardware and Overview of Processing

Referring to FIG. 1, herein, a computer system 101 comprises a processor 102 connected to a memory 103. The computer system may be a desktop type system. Processor 102 may be connected to one or more input devices, such as keyboard 104, configured to transfer data, programs or signals into processor 102. The input device, representing the human-computer interface, may also comprise a mouse for enabling more versatile input methodologies to be employed. The processor 102 receives data via an input port 105 and outputs data to data output devices 106, 107 and 108. The data may comprise audio-visual data having a recorded still image content or a moving video content, as well as a time varying audio data, or the data may be audio data alone, without image or video data. In each case, the audio data for an input data source comprising spatial audio, processor 102 is configured to play the audio data and output the resultant sound through a speaker system comprising speakers 106 and 107. If the input data also includes image data then processor 102 may also comprise an image processor configured to display the processed imaged data on a suitably configured display such as visual display unit 108. The audio data and/or video data received via input port 105 is stored in memory 103.

Figure 2:
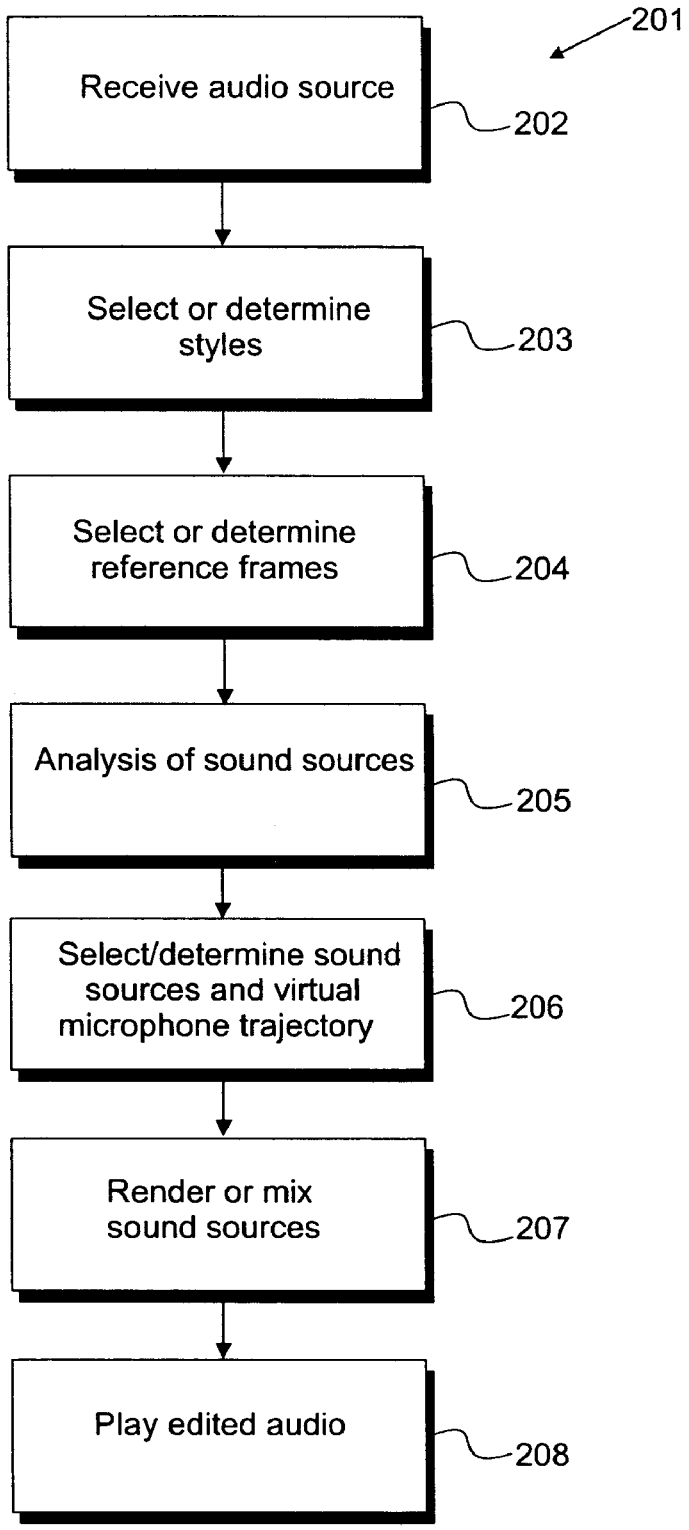
FIG. 2 schematically illustrates, computer implemented processes undertaken under control of a preferred embodiment of a virtual microphone application program.

Referring to FIG. 2 herein, there is illustrated schematically an application program 201. The application program 201 may be stored in memory 103.

Application program 201 is configured to receive and process a set of audio data received via data input port 105 and representative of a recorded sound scene such that the audio data is characterized into a set of sound sources located in a reference frame comprising a plurality of spatial dimensions and at least one temporal dimension. The application program 201 is configured to perform an analysis of the audio data to identify characteristic sounds associated with the sound sources and also to generate a set of modified audio data such that the modified audio data represents sound captured from at least one virtual microphone configurable to move about the recorded sound scene. The modified audio data generated by the application program 201 provides a playable "audio programme" representing a virtual microphone moving about the recorded sound scene. This audio programme can thereafter be played on an audio player, such as provided by processor 102, to generate resultant sound through speaker system 106, 107.

The acquired audio data is stored in memory 103. The application program 201 is launched, and the location of the file holding the audio data in is accessed by the program. The application program 201, operating under the control of processor 102, performs an analysis of the image data such that particular characteristics of the audio content (that is particular pre-defined characteristic sounds) are identified. The application program then proceeds to generate the above mentioned modified audio data based on the identified audio content characteristics. To facilitate this, the application program 201 includes an algorithm comprising a set of rules for determining how the audio programme should play the resultant modified audio data based on the different audio characteristics that have been identified.

An overview of the main processes undertaken by a preferred embodiment of a virtual microphone application program 201, is schematically illustrated in FIG. 2. At 202, processor 102 is configured to receive the audio data. The audio data is characterized by the processor by determining the style of the sound recording and determining an appropriate reference frame in which the virtual microphone is to reside in. In process 203 the application program is configured to select or determine the style of the sound recording (that is the general type of sound scene) that is being processed. At process 204 the application program is configured to select or determine the appropriate reference frame or frames in which the resultant virtual microphone or plurality of virtual microphones being generated is/are to apply. At process 205 the application program 201 is configured to perform an analysis of the sound sources so as to prepare the way for selecting sound sources and defining one or more resultant virtual microphone trajectories and/or fields of reception.

At process 206 application program 201 is configured to undertake a search to select/determine a set of sound sources (based on an optimized saliency calculation resulting in either an optimal selection or one of a set of acceptable results). The selected result is then used to determine one or more virtual microphone trajectories.

Following process 206, at process 207 application program 201 is configured to render or mix the sound sources so as to provide a resultant edited version of the recorded sound scene which may then be played back to a listener as mentioned above and as indicated at process 208. Rendering is the process of using the virtual microphone trajectory and selections of process 206 to produce an output sound signal. In the best mode contemplated application program 201 is configured to automatically determine the movement of and change of field of reception of the one or more virtual microphones. However the application program may be configured to permit semi-automatic processing according to choices made of certain parameters in each of the processes of FIG. 2 as selected by an operator of application program 201.

In this specification, the following terms have the following meanings.

"Spatial Sound": Spatial sound is modelled as a set of identified sound sources mapped to their normalised sound signals and their trajectories. Each sound source is represented as a sound signal. Spatial sound as thus defined conveys some information concerning the location of a perceived sound in three-dimensional space. Although the best mode utilises such "spatially localised sound" it is to be understood by those skilled in the art that other forms of sound that convey some degree of spatial information may be utilised. One good example is "directional sound", that is sound which conveys some information concerning the direction from which a perceived sound is derived.

"Trajectory": The trajectory of an entity is a mapping from time to position where position could be a three dimensional space co-ordinate. In the best mode contemplated 'position' also includes orientation information and thus in this case trajectory is a mapping from time to position and orientation of a given sound source. The reason for defining trajectory in this way is that some sound sources, such as for example a loudhailer, do not radiate sound uniformly in all directions. Therefore in order to synthesise the intensity of the sound detected by a microphone at a particular position it is necessary to determine the orientation of the sound source (and the microphone). A further consideration that may be taken into account is that a sound source may be diffuse and therefore an improved solution would regard the sound source as occupying a region rather than being a point source.

"Sound Signal": The sound signal is a mapping from time to intensity. In other words the intensity of a sound signal may vary with time.

"Sound Feature": A feature is a recognised type of sound such as human speech, non-speech (e.g. whistle, scream) etc.

"Recogniser": A recogniser classifies a sound signal and so maps sound signals to sets of features. Within an interval of recorded sound it is required to determine where in the interval the feature occurs. In the best mode a recogniser function returns a mapping from time to a feature set.

"Saliency": Saliency is defined as a measure of the inherent interest of a given sound that is realised by a notional human listener. In the best mode application program 102 uses real numbers for the saliency metric. Those skilled in the art will realise that there are a wide variety of possibilities for implementing saliency measure. In the preferred embodiment described below saliency calculations only involve arithmetic to decide which of a number of calculated saliency measures is the greatest in magnitude.

"Style": The style parameter is a mechanism for giving top down choices to the saliency measures (and associated constraints) that are used in the search procedure 206. The overall duration of the edited audio may be determined bottom up from the contents of the spatial sound, or it may be given in a top-down fashion through the style parameter. In the best mode both styles are accommodated through the mechanism of defining a tolerance within which the actual duration should be of target duration. The style parameter sets the level of interest, in the form of a score, assigned to particular features and groups of features.

"Virtual Microphone": A virtual microphone trajectory specifies the position (3D co-ordinates and 3D orientation) and its reception. The implementation of application program 201 is simplified if the position includes orientation information because then reception needs to change only because a non-monopole radiator has rotated. The virtual microphone can move and rotate and change its field of view. The sound received at a microphone is a function of the position of the process 207 of sound source and the microphone. In the simplistic model employed in process 207 of the preferred embodiment described herein sound reflections are ignored and the model simply takes into account the inverse square law of sound intensity.

"Reception": The reception (otherwise termed "listening" herein) of the virtual microphone may be defined in various ways. In the preferred embodiment it is defined as the distance between the position of the virtual microphone and the position of the sound source. This distance is then used to reduce or increase (i.e. blend) the intensity of the sound source at the position of the virtual microphone. This definition provides a simple and intuitive way of defining contours of reception for a region. More complex embodiments may additionally use one or more other parameters to define reception.

As described later the reception is a function implementing the modification of the normalised sound signals associated with each sound source. It uses the position of the virtual microphone and sound source to determine a multiplier that is applied to the sound source signal for a particular time. The reception defines how sensitive a microphone is to sounds in different directions. i.e. a directional microphone will have a different reception as compared with an omnidirectional microphone. The directional microphone will have a reception of zero for certain positions whereas the onmidirectional microphone will be non-zero all around the microphone, but might weight some directions more than others.

"Audio Rostrum Function 206": The audio rostrum function or processing routine 206 can be seen as a function taking a style parameter and spatial sound and returning a selection of the spatial sound sources and a virtual microphone trajectory. One or more virtual microphones may be defined in respect of a given sound scene that is the subject of processing by application program 201.

"Selection Function": The selection function of the audio rostrum process 206 is simply a means of selecting or weighting particular sound sources from the input spatial sound. Conceptually the selection function derives a new version of the spatial sound from the original source and the virtual microphone trajectory is rendered within the new version of the spatial sound. It may be implemented as a Boolean function to return a REAL value, returning a "0" to reject a sound source and returning a "1" to accept it. However in the best mode it is implemented to provide a degree of blending of an element of the sound source.

"Rendering Function": Rendering is the process of using the virtual microphone trajectory and selection to produce an output signal.

"Normalisation of sound signals": On recording of each sound signal, the signals may be recorded with different signal strengths (corresponding to different signal amplitudes). In order to be able to process the different sounds without having the sound strength varying in a manner which is unpredictable to a processor, each sound signal is normalised. That is to say, the maximum amplitude of the signal is set to a pre-set level, which is the same for all sound signals. This enables each signal to be referenced to a common maximum signal amplitude level, which means that subsequent processing stages can receive different sound signals which have amplitudes which are within a defined range of levels.

Examples of Sound Scenes and Virtual Microphone Synthesis

In order to demonstrate the effects produced by virtual microphone application program 201, FIGS. 3*a* to 3*d* schematically illustrate an example of a processed audio scene that may result from applying program 201 to a sound scene that has been recorded by a spatial sound capture device. The sound scene illustrated comprises a man and a woman, constituting a couple, taking coffee in a café in St Mark's Square in Venice. A complex audio data is recorded by an array of microphones carried by one of the couple the audio data representing the sound scene comprising a plurality of sound sources, each occupying positions and/or individual trajectories within a reference frame having three spatial dimensions and a time dimension. FIGS. 3*a* to 3*d* respectively represent maps showing spatial layout at different times and they respectively thereby provide an auditory storyboard of the events at successive times.

Figure 3A:
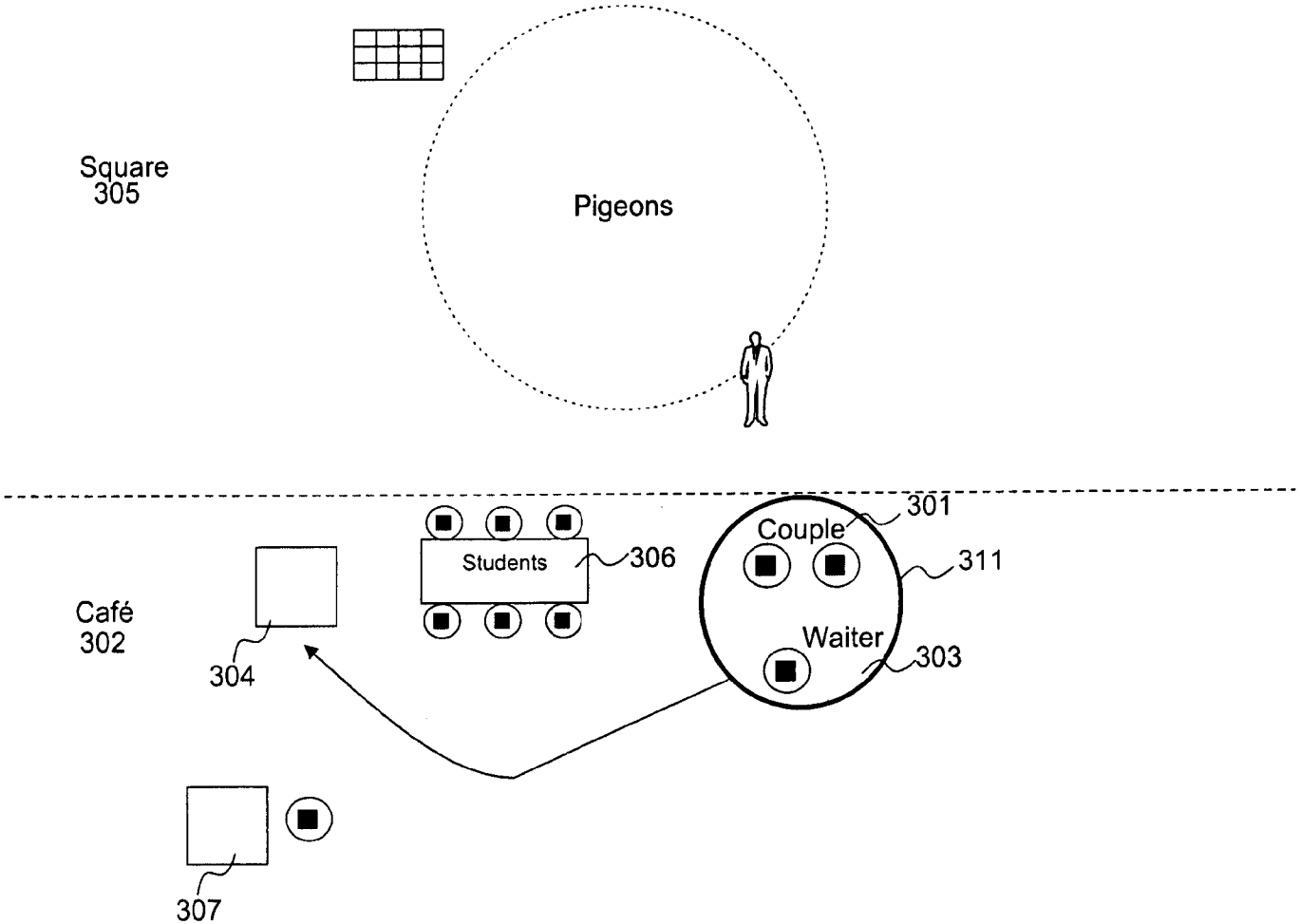
FIGS. 3*a*-3*d* schematically illustrate an example of a processed complex spatio-temporal audio scene that may result from operation of the application program of FIG. 2.

In FIG. 3*a* herein, the couple 301 enter the café 302 and are greeted by a waiter 303. Upon requesting coffee, the waiter directs the couple to a table 304 looking out onto the Square 305. As the couple walk towards table 304 they pass by two tables, table 306 where a group of students are sitting and another, table 307, where a man is reading a newspaper.

Figure 3B:
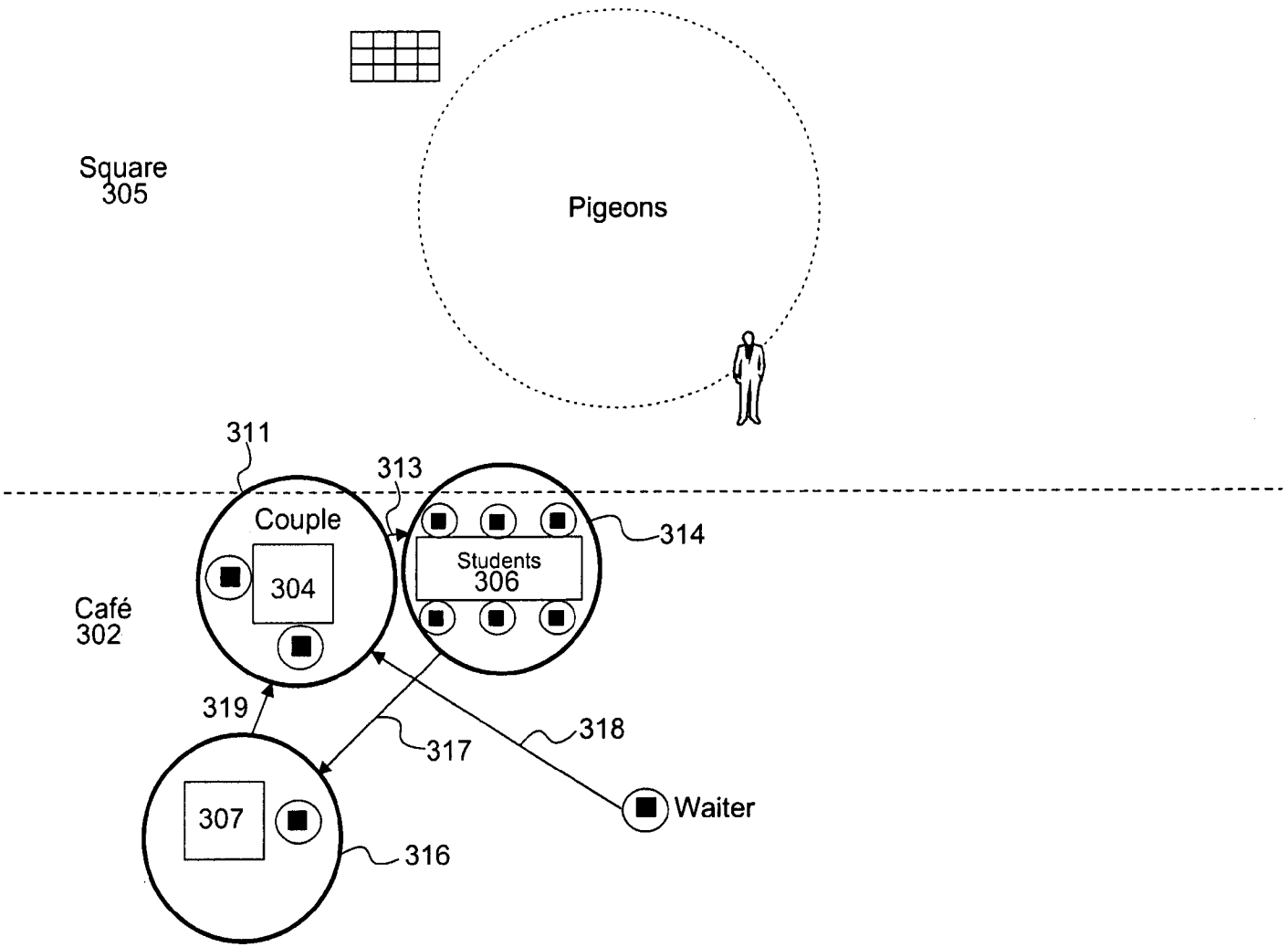

In FIG. 3*b* herein, the couple, having taken their seats at table 304, are schematically illustrated as waiting for their coffee to arrive and whilst doing so they look towards the students at table 306 and then at the man reading the newspaper at table 307. Subsequently the waiter arrives and the couple take their coffee.

Figure 3C:
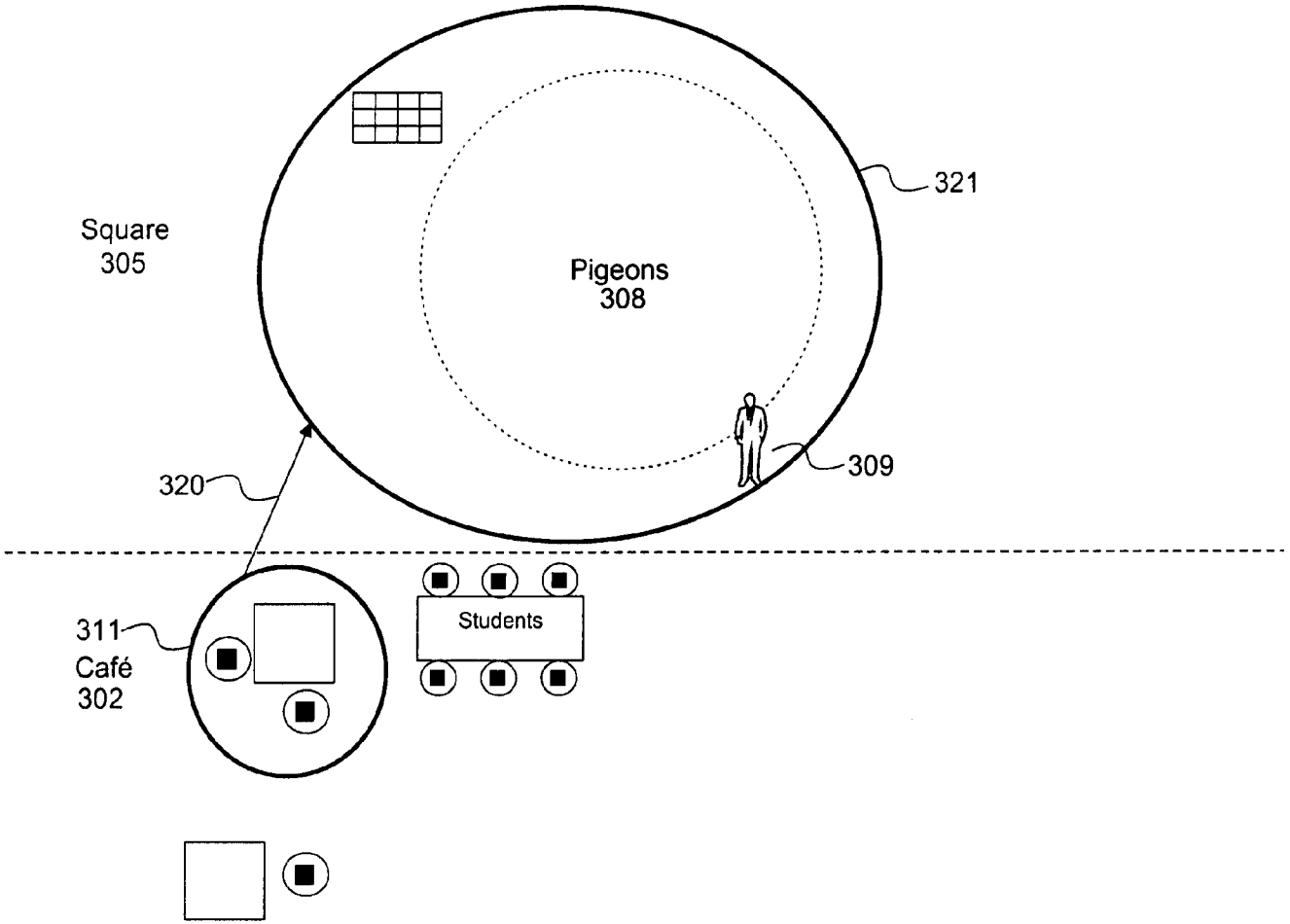

Following the events of FIG. 3*b*, in FIG. 3*c* herein, the couple then look out into the Square and take in the sounds of the Square as a whole with particular focus on the pigeons 308.

Figure 3D:
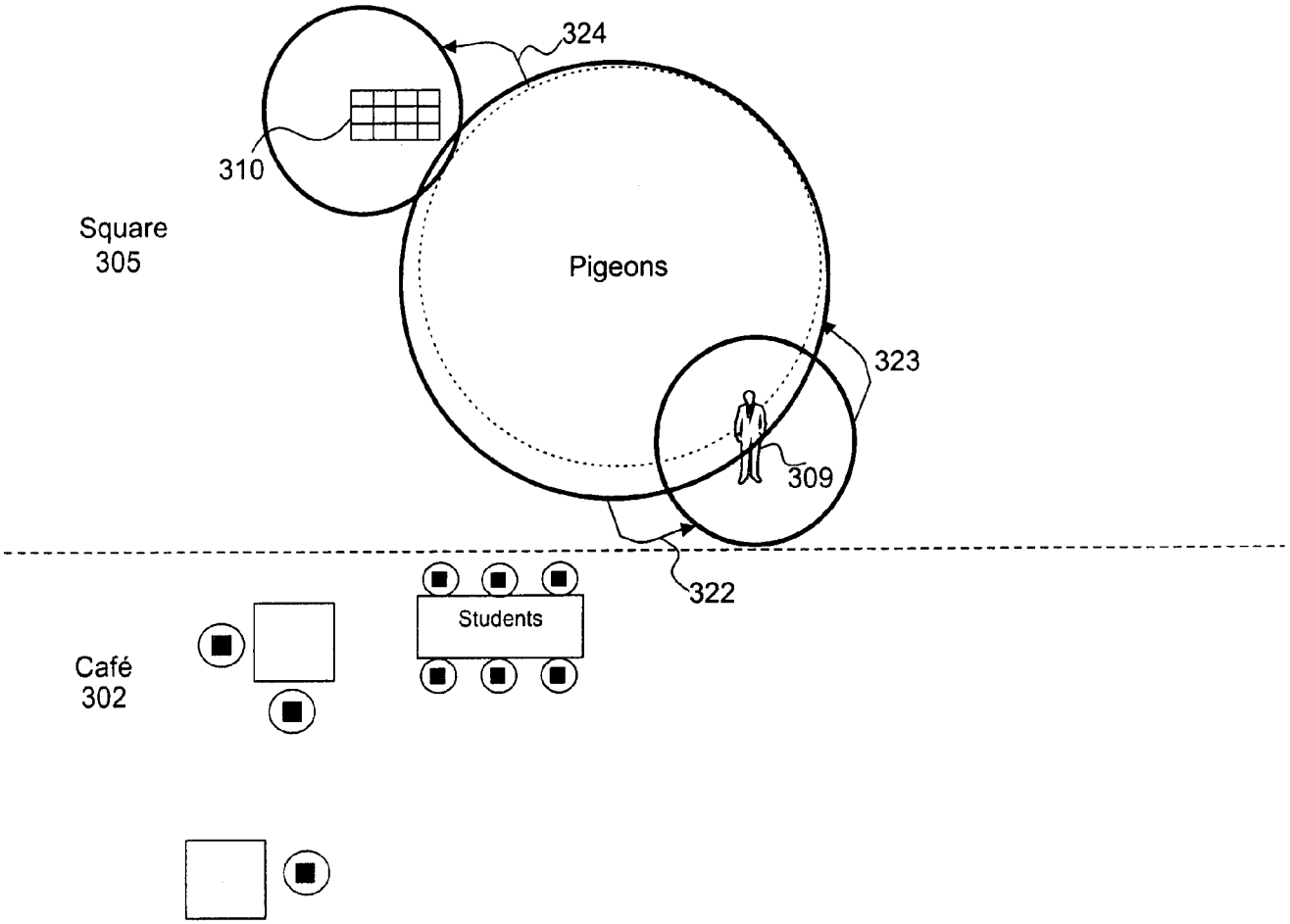

Following FIG. 3*c*, in FIG. 3*d* herein, the attention of the couple is shown as having been directed from the Square as a whole to a man 309 feeding the pigeons, their attention then being drawn back to the pigeons and then to a barrel organ 310 playing in the distance.

In this example, the sound scene recorded as audio data by the couple is subsequently required to be played back in a modified form to friends and family. The played back version of the audio sound recording is required to be modified from the original audio data so as to provide the friends and family with a degree of interest in the recording by way of their being made to feel that they were actually in the scene themselves. In the preferred embodiment, the modified audio is played in conjunction with a video recording so that the listener of the audio is also provided with the actual images depicted in FIGS. 3*a* to 3*d* in addition to processed audio content. At least one virtual microphone is generated to follow the couple and move about with them as they talk with the waiter. In FIG. 3*a* the virtual microphone field of reception is schematically illustrated by bold bounding circle 311. Bounding circle 311 represents the field of reception of the virtual microphone that has been configured by application program 201 to track the sounds associated with the couple. Other sound sources from the Square are removed or reduced in intensity so that the viewer/listener of the played back recording can focus on the interaction with the waiter 303. The auditory field of view (more correctly termed the auditory field of reception) is manipulated to achieve this goal as is illustrated schematically in FIGS. 3*a* to 3*d* and as described below.

In FIG. 3*a* the couple are illustrated by arrow 312 as walking by student table 306 and table 307. The virtual microphone reception 311 is initially focused around the couple and the waiter, but is allowed to briefly move over to the table with the students (mimicking discrete listening), and similarly over to the man reading the paper at table 307 and whose paper rustles as he moves it out of their way. The virtual microphone 311 then moves back to the couple who sit down as indicated in FIG. 3*b* to listen to them. Whilst waiting for their coffee the attention of the couple is shown as wandering over to their fellow guests. First they listen to the laughter and jokes coming from the student table 306—this is indicated by the field of listening of the virtual microphone having moved over to the student table as indicated by virtual microphone movement arrow 313 resulting in the virtual microphone field of listening being substantially around the students. Following their attention being directed to the student table, the couple then look at the man reading the newspaper at table 307 and they watch him stirring his coffee and turning the pages of the newspaper. The field of listening of the virtual microphone is indicated by arrow 314 as therefore moving from student table 306 to its new position indicated around table 307. Following the focusing in of the virtual microphone on table 307, the waiter then arrives with the couple's coffee as indicated by arrow 315 and the listener of the processed sound recording hears the sound of coffee being poured by the waiter and then the chink of china before the couple settle back to relax. The change of field of reception of the virtual microphone from table 307 back to table 304 is indicated by virtual microphone change of field of view arrow 316. The changes occurring to the virtual microphone include expansion of the field of listening from the people to include more of the café as the virtual microphone drifts or pans over to and zooms in on the student table 306 before then drifting over to the man reading the newspaper at table 307.

Following the scene of FIG. 3*b*, the couple relax and take their coffee as indicated in FIG. 3*c*. The virtual microphone has drifted back to the couple as indicated by bounding circle 311 around table 304. As the couple then relax they look out onto St Mark's Square and the virtual microphone drifts out from the café as indicated by virtual microphone and change of reception arrow 317 to zoom in on the pigeons 308 in the Square 305. Thus the virtual microphone field of listening expands, as indicated, to take in the sounds from the Square as a whole, the resultant virtual microphone field of listening being indicated by bounding bold ellipse 318. Following the events schematically illustrated in FIG. 3*c*, further changes in the field of listening of the virtual microphone are illustrated. From the virtual microphone field of reception 318 taking sounds from the Square as a whole, as indicated by arrow 319 the virtual microphone field of listening shrinks and then zooms in on the man 309 who is feeding the pigeons 308, the man throwing corn and the pigeons landing on his arm to eat some bread. After this the virtual microphone then leaves the man feeding the pigeons, expands and drifts back to take in the sounds of the pigeons the square as indicated by arrow 320. Thereafter the virtual microphone expands to encompass the whole Square before zooming in on the barrel organ 310 as indicated by arrow 321.

The motion of the virtual microphone and expansion/contraction of the field of listening as described in the example of FIGS. 3*a*-3*c* are given for exemplary purposes only. In reality application program 201 may produce more complicated changes to the virtual microphone and in particular the shape of the field of listening may be expected to be more complex and less well defined than that of the bounding circles and ellipse described above. Furthermore rather than only generating a single virtual microphone as described in the example it is to be understood that application program 201 it is to be understood that a suitably configured application program may be capable of generating a plurality of virtual microphones depending on a particular user's requirements.

The example sound scene environment of FIGS. 3*a* to 3*d* concerns a virtual microphone being configured to move about a recorded spatial sound scene. However a virtual microphone audio processing may be configured to operate such that the virtual microphone remains stationary relative to the movements of the actual physical sound capture device that recorded the scene.

An example of the scope of application of the presently described embodiments and methods is to consider the well-known fairground ride of the "merry-go-round". The embodiments and methods may be used to process sound captured by a spatial sound capture device located on a person who takes a ride on the merry-go-round. The application program 201 may process the recorded spatial sound so that it is re-played from a stationery frame of reference relative to the rotating merry-go-round from which it is recorded. Thus the application program is not to be considered as limited to merely enabling sound sources to be tracked and zoomed in on by a moving virtual microphone since it may also be used to "step-back" from a moving frame of reference, upon which is mounted a spatial sound capture device, to a stationary frame. In this way the present there may be provided useful application in a wide variety of possible situations where captured spatial sound is required to be played back from the point of view of a different frame of reference to that in which it was actually recorded.

Acquiring Audio Data, Process 202

A source of spatial sound is obtained. As will be understood by those skilled in the art this may be obtained in a variety of ways and is not to be considered as limited to any particular method. However it will also be understood that the particular method employed will affect the specific configuration of data processing processes 203-207 to some degree.

One commonly employed method of obtaining spatial sound is to use a microphone array such that information on the spatial position of the microphones with respect to the sound sources is known at any given time. In this case the rendering process 207 should be configured to utilize the stored information, thereby simplifying the rendering process. Another example is to obtain spatially localized sound from a virtual (computer generated) source and to utilize the positional information that is supplied with it.

Methods of obtaining spatial sound and of separating and localizing sound sources are detailed below.

Obtaining Spatial Sound

There are a number of different spatially characterised soundscapes that application program 201 may be configured to use:

1. Soundscapes captured using multiple microphones with unknown trajectories. e.g. where several people are carrying microphones and the variation in the position of each microphone either has or can be calculated over time.

2. Virtual reality soundscapes such as defined by the webs VRML (Virtual Reality Modelling Language) that can describe the acoustical properties of the virtual environment and the sounds emitted by different sources as they move about the virtual world (in 3D space and time).

3. Spatial sound captured using microphone arrays. Here there are multiple microphones with known relative positions that can be used to determine the location of sound sources in the environment.

4. Soundscapes captured using a set of microphone arrays with each microphone array knowing the relative positions of its microphones, but not knowing the spatial positions of the other microphone arrays.

It should be noted that with microphone arrays (method no. 3 above) the relative positions of the microphones in the array are known, whereas in the general case (method no. 1) the relative positions of the microphones have to be determined. It will be understood by those skilled in the art that the different characteristics associated with spatially characterised sound obtained from each of the four methods (1)-(4) affects the more detailed configuration requirements of application program 201. In consequence of this different versions of the underlying processing algorithms result that exploit the different characteristics and/or which work within the limitations of a particular source of spatial sound.

In the case of method no. 1 above, use of multiple microphones, this does not decompose the environment into distinct spatial sound sources, although a physical microphone located on a sound source, such as a person, will mean that the sound captured is dominated by this sound source. Ideally such a sound source would be separated from its carrier to provide a pure spatially characterised sound. However this might not be possible without distorting the signal. Specific implementations of application program 201 may be configured to work with such impure forms of spatial sound. In the simplest case a suitably configured application program 201 might simply switch between different microphones. In a more sophisticated version, application program 201 may be configured to separate the sound source co-located with the physical microphone from the other sounds in the environment and allow a virtual microphone to take positions around the original sound source. It is also possible to determine the relative position of a microphone co-located sound source whenever it is radiating sound because this gives the clearest mechanism for separating sounds from the general microphone mix. However any reliably separated sound source heard by multiple microphones could be used to constrain the location of the sound sources and the microphones.

Even if processing were performed to identify sound sources it is likely to be error prone and not robust. This is because errors arise in the determination of the location of a sound source both in its exact position and in the identification of an actual sound source as opposed to its reflection (a reflection can be mistaken for a sound source and vice versa). Application program 201 needs to take the probability of such errors into account and it should be conservative in the amount of movement of and the selecting and editing of sound sources that it performs.

Identification of spatial sound sources is difficult for diffuse sound sources such as, for example, motorway noise or the sound of the sea meeting the shore. This is due to a lack of a point of origin for such diffuse sound sources. Other diffuse sound sources such as a flock of birds consisting of indistinguishable sound sources also present problems that would need to be taken into account in a practical spatial sound representation as used by a suitably configured application program 201.

If the output from application program 201 is intended to be spatial sound then there is greater emphasis required on the accuracy of the locations and labelling of different spatial sound sources. This is because not only should the output sound be plausible, but application program 201 should also give plausible spatial sound cues to the listener of the resultant edited sound scene that is produced. This is unlikely to be possible without an accurate 3D model of the environment complete with its acoustic properties and a truly accurate representation will generally only available or possible when the spatial sound comes from a synthetic or virtual environment in the first place.

Sound Source Separation and Determination of Location of Sound Sources

Given access to a sound field application program 201 is then required to recover the separate components if these have not already been determined. Solution of this problem concerns dealing with the following degrees of freedom: greater than N signals from N sensors where N is the number of sensors in the sound field. There are two general approaches to solving this problem:

Information-Theoretic Approaches

This type uses only very general constraints and relies on precision measurements; and Anthropic Approaches This type is based on examining human perception and then attempting to use the information obtained.

Two important methods of separating and localising sound sources are (i) use of microphone arrays and (ii) use of binaural models. In order to better understand the requirements for configuring application program 201 further details of these two methods are provided below.

(i) Microphone Arrays

Use of microphone arrays may be considered to represent a conventional engineering approach to solving the problem. The problem is treated as an inverse problem taking multiple channels with mixed signals and determining the separate signals that account for the measurements. As with all inverse problems this approach is under-determined and it may produce multiple solutions. It is also vulnerable to noise.

Two approaches to obtaining multiple channels include combining signals from multiple microphones to enhance/cancel certain sound sources and making use of 'coincident' microphones with different directional gains.

The general name given to the techniques used to solve this problem is, as is known to those skilled in the art, "Adaptive Beamforming & Independent Component Analysis (ICA)". This involves formulation of mathematical criteria to optimise the process for determination of a solution. The method includes (a) beamforming to drive any interference associated with the sound sources to zero (energy during non-target intervals is effectively cancelled) and (b) independent component analysis to maximise mutual independence of the outputs from higher order moments during overlap. The method is limited in terms of separation model parameter space and may, in a given implementation, be restricted to a sound field comprising N sound source signals from N sensors.

The following references, incorporated herein by reference, provide detailed information as regards sound source separation and localisation using microphone arrays:

Sumit Basu, Steve Schwartz, and Alex Pentland.

"Wearable Phased Arrays for Sound Localisation and Enhancement." In Proceedings of the IEEE Int'l Symposium on Wearable Computing (ISWC '00). Atlanta, Ga. October, 2000. pp. 103-110. (PDF) (slides);

Sumit Basu, Brian Clarkson, and Alex Pentland.

"Smart Headphones." In Proceedings of the Conference on Human Factors in Computing Systems (CHI '01). Seattle, Wash. April, 2001. (PDF) (slides);

Valin, J.-M., Michaud, F., Hadjou, B., Rouat, J.,

Localisation of Simultaneous Moving Sound Sources for Mobile Robot Using a Frequency-Domain Steered Beamformer Approach.

Accepted for publication in IEEE International Conference on Robotics and Automation (ICRA), 2004;

Valin, J.-M., Michaud, F., Rouat, J., Letourneau, D.,

Robust Sound Source Localisation Using a Microphone Array on a Mobile Robot.

Proc. IEEE/RSJ International Conference on Intelligent Robots and Systems, 2003;

Microphone-Array Localisation Error Estimation with Application to Sensor Placement (1995)

Michael Brandstein, John E. Adcock, Harvey F. Silverman;

Algebraic Methods for Deterministic Blind Beamforming (1998)

Alle-Jan van der Veen;

Casey, M. A.; Westner, W., "Separation of Mixed Audio Sources by Independent Subspace Analysis", International Computer Music Conference (ICMC), August 2000;

B. Kollmeier, J. Peissig, and V. Hohmann,

"Binaural noise-reduction hearing aid scheme with real-time processing in the frequency domain,"

Scand. Audiol. Suppl., vol. 38, pp. 28-38, 1993;

Shoko Araki, Shoji Makino, Ryo Mukai & Hiroshi Saruwatari

Equivalence between Frequency Domain Blind Source Separation and Frequency Domain Adaptive Beamformers;

(ii) Binaural Models

Human listeners have only two audio channels (by way of the human ears) and are more able to accurately separate out and determine the location of sound sources than can a conventional microphone array based system. For this reason there are many approaches to emulating human sound localisation abilities, the main ones concentrating on the main cues to spatial hearing of interaural time difference, interaural intensity difference and spectral detail.

Extraction of Interaural Time Difference Cues

The interaural time difference (ITD) cue arises due to the different path lengths around the head to each ear. Below 1.5 KHz it is the dominant cue that people use to determine the location of a sound source. However the ITD cue only resolves spatial position to a cone of confusion. The basic approach is to perform cross-correlation to determine the timing differences.

Extraction of Interaural Intensity Difference Cues

Interaural intensity difference (IID) arises due to the shadowing of the far ear, and is negligible for low frequency, but becomes more useful for higher frequencies.

Extraction of Spectral Detail

The shape of the pinnae introduces reflections and spectral detail that is dependent on elevation. It is because of this that IID cues are used by people for detecting range and elevation. Head motion is a means of introducing synchronised spectral change.

Once the direction of the sound sources has been determined they can then be separated by application program 201 (assuming this is required in that sound sources have not been provided in a pre-processed format) based upon direction. As will be understood by those skilled in the art separation of sound sources based on direction may involve one or more of:

estimating direction locally;

choosing target direction; and removing or minimising energy received from other directions.

The following references, incorporated herein by reference, provide detailed information as regards auditory scene analysis/binaural models:

G. J. Brown and M. P. Cooke (1994)

Computational auditory scene analysis. Computer Speech and Language, 8, pp. 297-336;

B. Kollmeier, J. Peissig, and V. Hohmann,

"Binaural noise-reduction hearing aid scheme with real-time processing in the frequency domain,"

Scand. Audiol. Suppl., vol. 38, pp. 28-38, 1993;

This latter reference provides further information on separation of sound sources based on direction.

Model and Application of a Binaural 360° Sound Localisation System (2001)

C. Schauer, H.-M. Gross

Lecture Notes in Computer Science;

Identification of Spectral Features as Sound Localisation Cues in the External Ear Acoustics Paul Hofman, John van Opstal

IWANN;

Enhancing sound sources by use of binaural spatial cues

Johannes Nix, Volker Hohmann

AG Medizinische Physik

Universitat Oldenburg, Germany;

Casey, M., "Sound Classification and Similarity Tools", in B. S. Manjunath, P. Salembier and T. Sikora, (Eds), Introduction to MPEG-7: Multimedia Content Description Language, J. Wiley, 2001; and Casey, M., "Generalized Sound Classification and Similarity in MPEG-7", Organised Sound, 6:2, 2002.

However a source of spatial sound is obtained the audio source may be received via input port 105 in a form wherein the spatial sound sources have already been determined with unattributable sources being labeled as such and echoes and reflections having being identified. In this case the spatial sound sources may be required to be normalized by application program 201 as described below. Normalization greatly simplifies the processing required in the subsequent analysis and rendering processes of the pipeline.

Normalization of Sound Signal

The spatially characterized sound source signals are normalized with the normalized signals being stored in memory 103. Normalization is required to simplify the main rendering task of placing a virtual microphone in the soundscape and synthesizing the sound signals that it would capture.

Normalization involves processing the signals so that the resultant stored signals are those that would have been obtained by a microphone array (i) located at the same position as regards orientation from and distance from each of the sound sources and (ii) preferably, in an environment that is free of reverberations. In the preferred embodiment normalisation is applied to the intensity of the sound sources. Normalisation processing is preferably arranged so that when the virtual microphone is placed equidistant from two similar sound sources then they are rendered with an intensity that is proportional to the intensity produced at each sound source.

If the spatial sound sources are captured using microphones in known positions then the intensity of the sound sources detected will vary with the relative position of the sound source and the microphone. Thus to render spatially characterised sound for an arbitrary virtual microphone position it is preferred to store the intensity of the sound source from a standard distance and orientation with respect to the sound source. This process simplifies the sound source rendering process 207, but introduces an extra resampling of the captured sound. It is also a process that simplifies the pattern recognition because each sound source need only be recognised from a standard distance. Those skilled in the art will appreciate that the alternative is to store the orientation and position of the sound source and microphone (which will vary over time) and resample for the actual virtual microphone used in rendering. This would only resample the recorded sound once thus giving maximum quality.

A further preferred embodiment as regards normalization comprises both of the aforementioned approaches: normalizing the sound signals associated with each sound source to make recognition easier and also storing the positions of the original microphones. This latter approach provides the benefits of both approaches, but at a computational cost in relation to extra storage and sampling.

Characterizing the Sound Scene into Sound Sources, 203, 204.

Select or Determine Styles, Process 203

In the preferred embodiment of application program 201 process 203 concerning selection or determination of style initially identifies which one of a plurality of predefined sound classes that the stored audio data to be processed actually represents. For automatic determination of styles the application program 201 is thus required to comprise a plurality of predefined sound classes in the form of stored exemplary waveforms.

Figure 4:
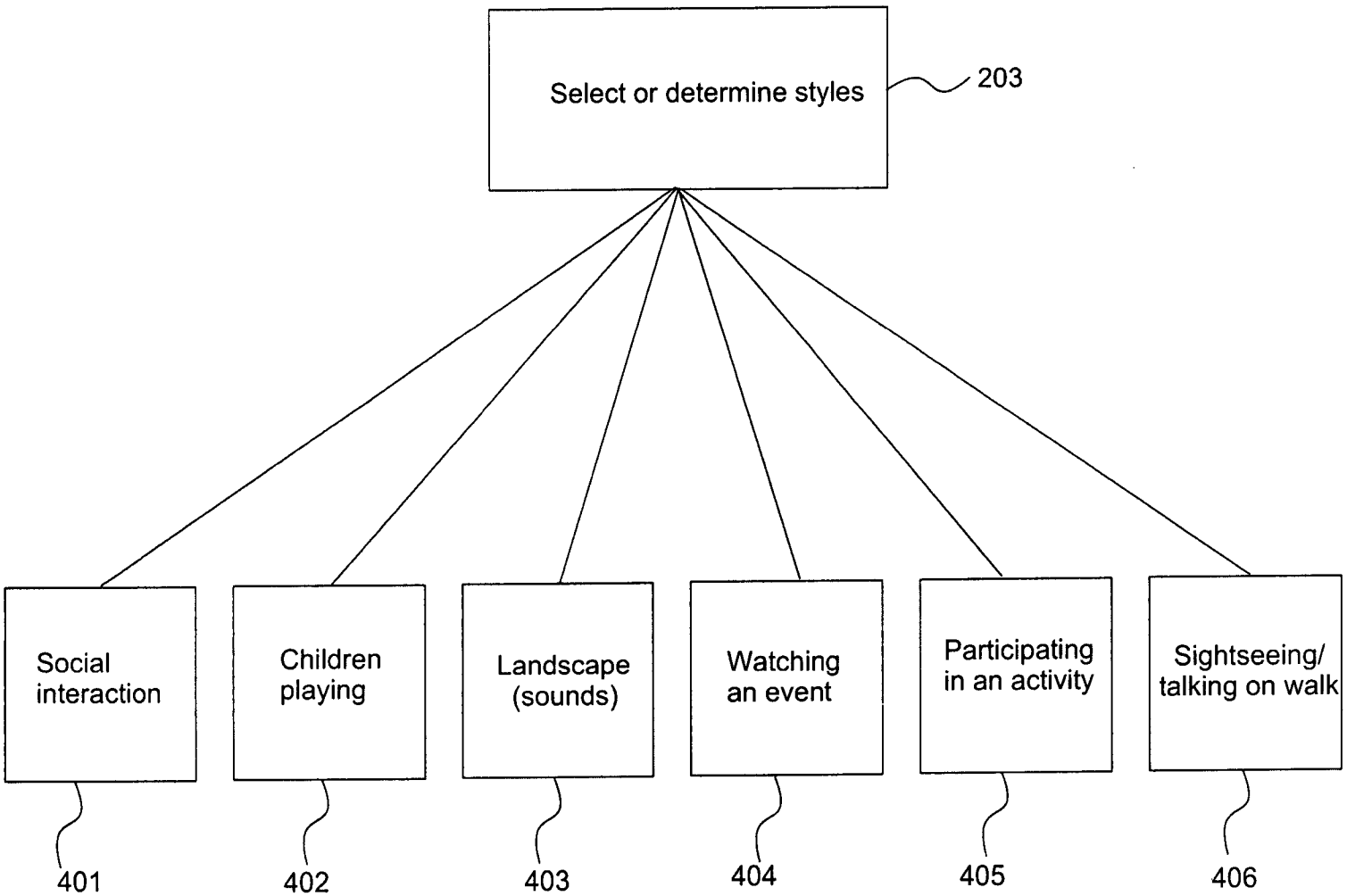
FIG. 4 further details the process illustrated in FIG. 3 of selecting processing styles associated with certain predefined types of spatial sound scenes.

Referring to FIG. 4 herein, there is illustrated schematically by way of example, a plurality of such predefined classes. In the example of FIG. 4 the predefined classes are: at 401, social interaction between two or more people; at 402, the sounds of children playing; at 403, the sound of a general landscape; at 404, sounds typifying watching of an event; at 405, sounds concerning participation of a person in an activity; and at 406, sounds associated with sight-seeing and/or people talking on a walk.

Process 203 concerning selection or determination of styles may be automatically effected by the application program 201 or the application program 201 may be configured to accept an appropriate selection made by an operator of the system. In general the style can be determined through:

user interaction via selection from a set of menu items or slider bars visible on a monitor or via explicit setting of particular parameters;

a priori or default settings (which may be varied randomly); and parameters determined externally of the application program if the application program forms part of a larger composition program.

Although the process for selection/determination of styles (process 203) is illustrated in FIG. 2 as immediately following process 202 it may be positioned at a different point in a sequence of the processes of FIG. 2 or it may be parallel processed with the other processes of FIG. 2. For example it may be invoked immediately after the sound source analysis process so as to permit the style parameters to be determined, at least in part, through the actual analysis or classification of the sounds sources themselves in addition to or instead of mechanisms (a)-(c) listed above.

Select or Determine Analysis Reference Frame (or Frames), Process 204 This process concerns selecting an appropriate analysis reference frame from:

a fixed reference frame of the type used in the example of FIGS. 3*a*-3*d*; or a reference frame that moves around.

In the best mode this decision is effected by the style determined either automatically or selected by the operator of application program 201 at process 203. The choice effects the overall style of the resultant edited soundscape produced by application program 201 and it effects the saliency accorded by application program 201 to particular sound sources.

Perform Analysis of Sound Sources, Process 205

Figure 5:
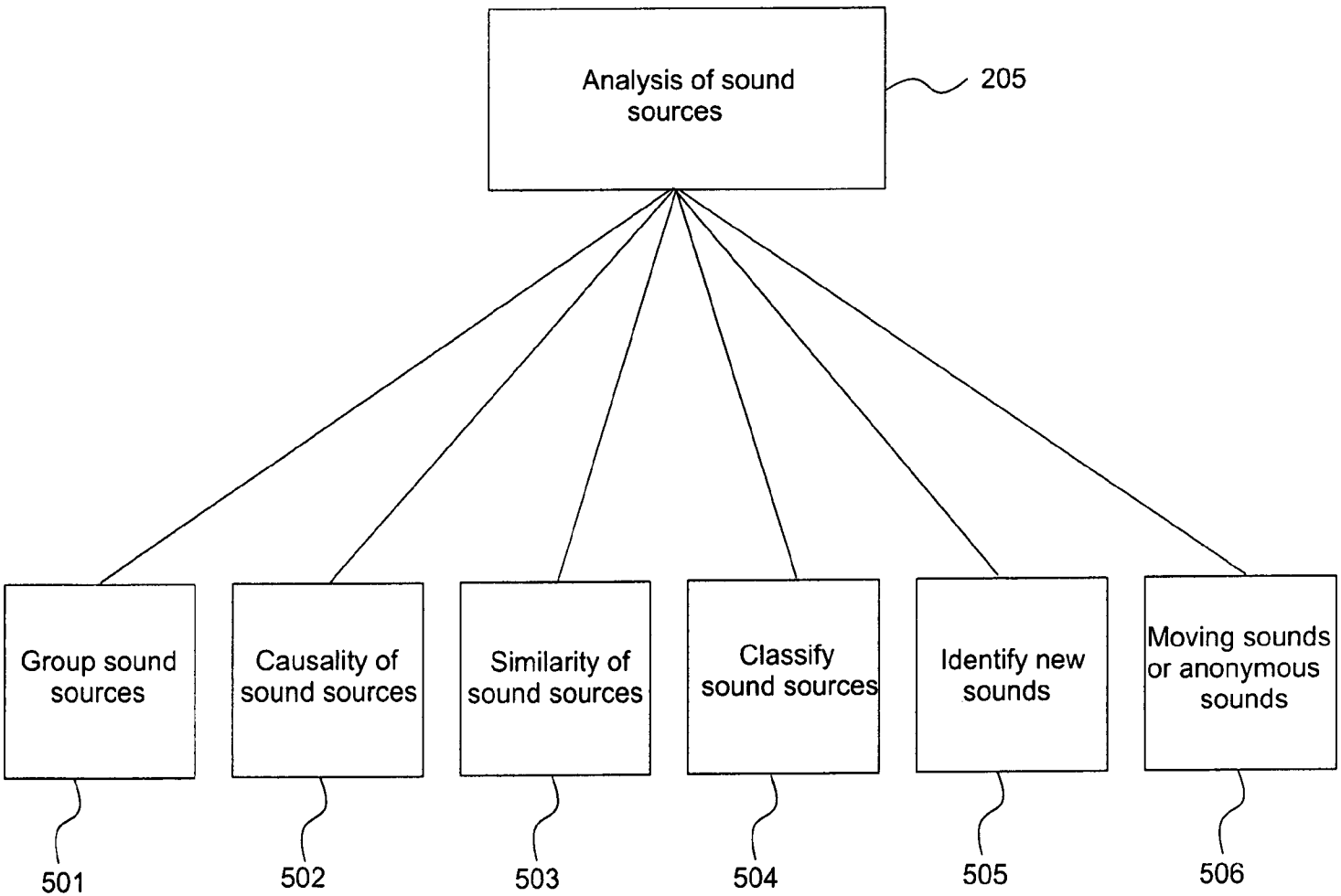
FIG. 5 further details process 205 of FIG. 2 of analyzing sound sources.

FIG. 5 herein further details process 205 of analyzing sound sources. The skilled person in the art will understand that the audio analysis may be performed, in most cases efficiently and effectively, by the use of a form of waveform analysis such as by making use of Fourier transform techniques. The main forms of analysis processing that application program 201 invokes to select particular sound sources, both spatially and temporally, are as follows:

Grouping together of sound sources as indicated at 501;

Determination of the causality of sound sources as indicated at 502;

Determination of the similarity of sound sources as indicated at 503;

Classification of the sound sources as indicated at 504;

Identification of new sounds as indicated at 505; and

Recognition of moving sound sources or anonymous sound sources as indicated at 506.

Grouping of Sound Sources, Process 501

Figure 6:
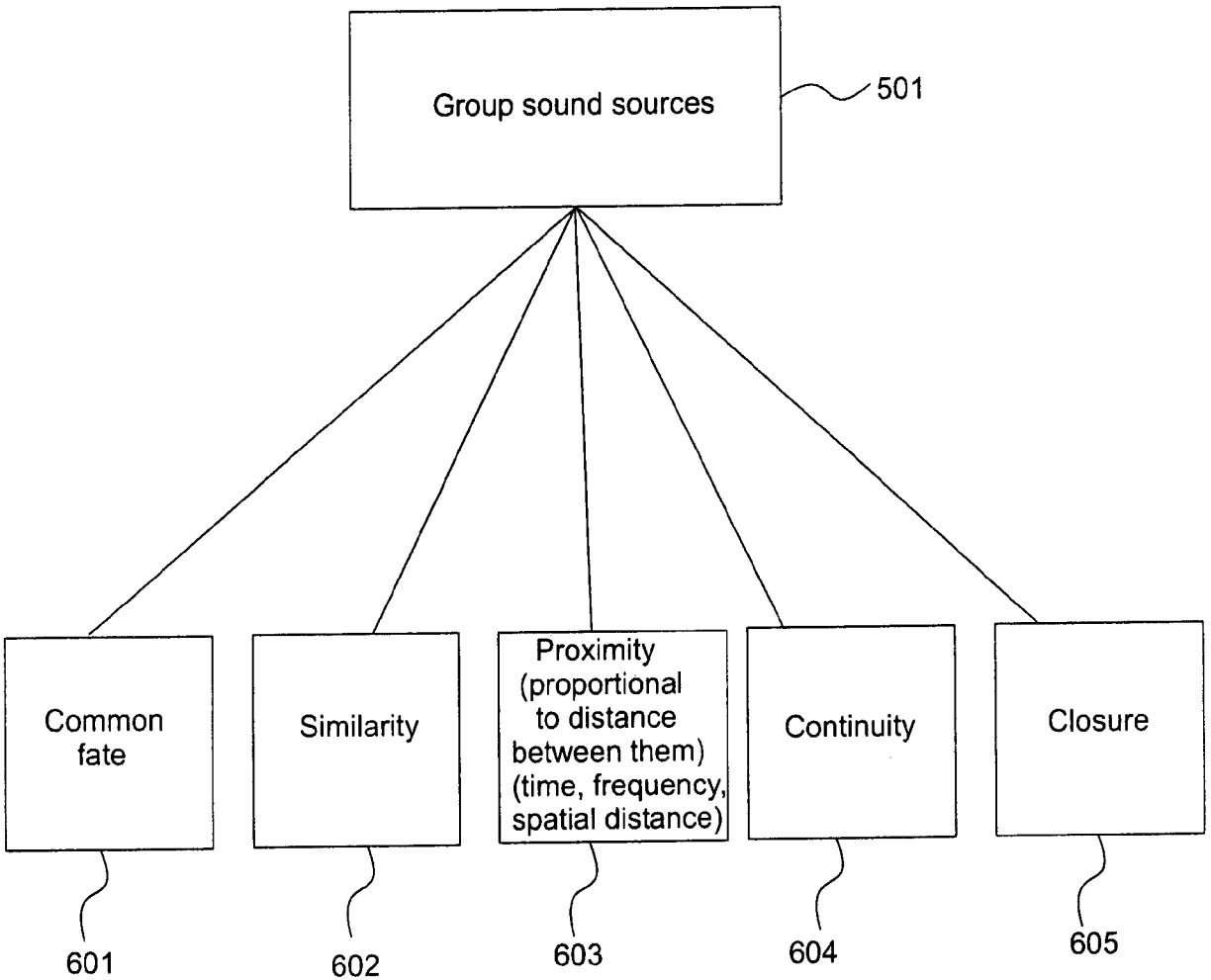
FIG. 6 further details the process illustrated in FIG. 5 of grouping sound sources.

FIG. 6 further details process 501 illustrated in FIG. 5 of grouping sound sources. Group processing process 501 determines which sound sources should be linked as a connected or related set of sources. The preferred approach is to configure application program 201 to base processing on Gestalt principles of competing grouping cues in accordance with the following processing functions:

Common fate process 601: Common fate describes the tendency to group sound sources whose properties change in a similar way over time. A good example is a common onset of sources.

Sound source similarity process 602: The similarity of sound sources according to some measure of the timbre, pitch or loudness correlation between the different sound sources indicates a tendency to group the sources.

Sound source proximity process 603: The proximity of sound sources in time, frequency and spatial position provides a good basis for grouping.

Sound source continuity process 604: The degree of smoothness between consecutive sound elements can be used to group, a higher degree of smoothness providing a greater tendency for application program 201 to link the elements as a group.

Sound source closure process 605: Sound sources that form a complete, but possibly partially obscured sound object, are required to be grouped.

Determination of the Causality of Sound Sources, Process 502

Application program 201 is configured to determine whether one sound source causes another sound source to occur. A good example of causality is where a person asks another person a question and the other person replies with an answer. This process thus comprises another means of grouping sound sources by means of cause and effect rather than being based upon Gestalt principles. In the example on FIGS. 3*a* to 3*d*, the group of six students sitting at table 306 would be a good candidate for grouping in this way. For example, the similarity between the timbre of different speakers may be used by application program 201 to determine that the same speaker is talking and this process could be enhanced with combining with some measure of co-location. A causality analysis of the student speakers would enable program 201 to determine that the speakers do not talk independently of each other, thus indicating possible causality between them. Causality processing in this way also requires some degree of temporal proximity as well as the sound sources being independent of each other, but spatially relatively close to one another.

Determination of the Similarity of Sound Sources, Process 503

Figure 7:
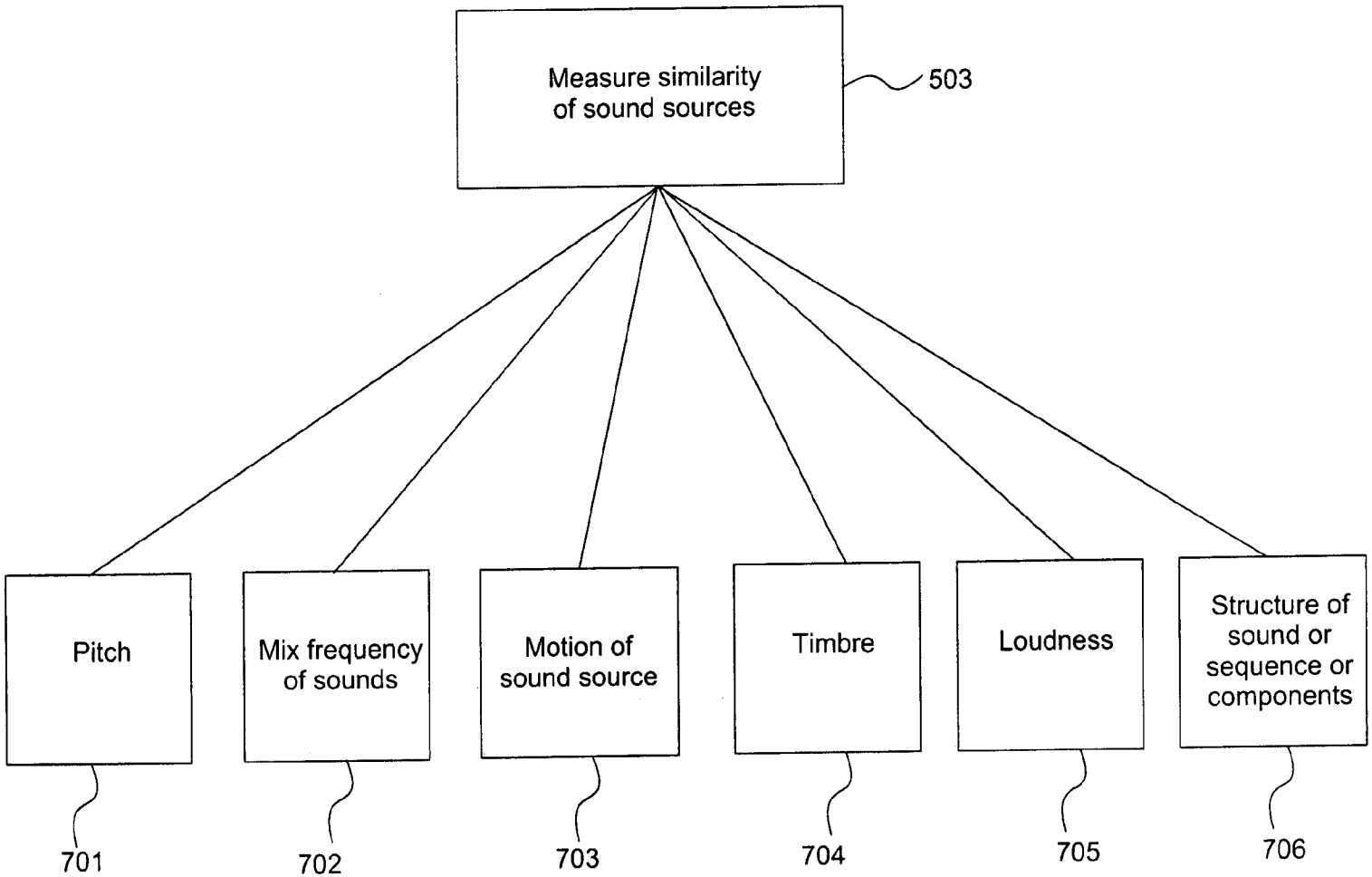
FIG. 7 further details the process illustrated in FIG. 5 of determining the similarity of sound sources.

FIG. 7 further details process 503 illustrated in FIG. 5 of determining the similarity of sound sources. Application program 201 is configured to determine the similarity of sound sources based upon a pre-defined metric of similarity in various aspects of sound. Thus, for example, processing could include determination of similarity in pitch as indicated at 701. Similarly process 702 could be invoked to determine the mix in the frequency of the sounds. Process 703 is configured to determine the motion associated with sound sources. Process 704 concerns determination of similarity based on timbre. Process 705 concerns determination of similarity based on loudness and process 706 concerns similarity determination based on the structure of the sounds or the sequence of the components of the particular sound sources being processed. A good example of similarity determination in this way would be similarity of determination based on pitch. This can be measured by frequency-based histograms counting the presence of certain frequencies within a time window and then performing a comparison of the histograms. There are many references concerning determination of similarity of and recognition of sound sources, but a preferred technique for use by application program 201 is that disclosed in U.S. Pat. No. 5,918,223 in the name of Muscle Fish, the contents of which are incorporated herein by reference. The Muscle Fish approach can also be used to perform a similarity measure since the Muscle Fish technique classifies sounds by measuring the similarity of sounds provided in the training data.

Classifying (Recognizing) Sound Sources, Process 504

Figure 8:
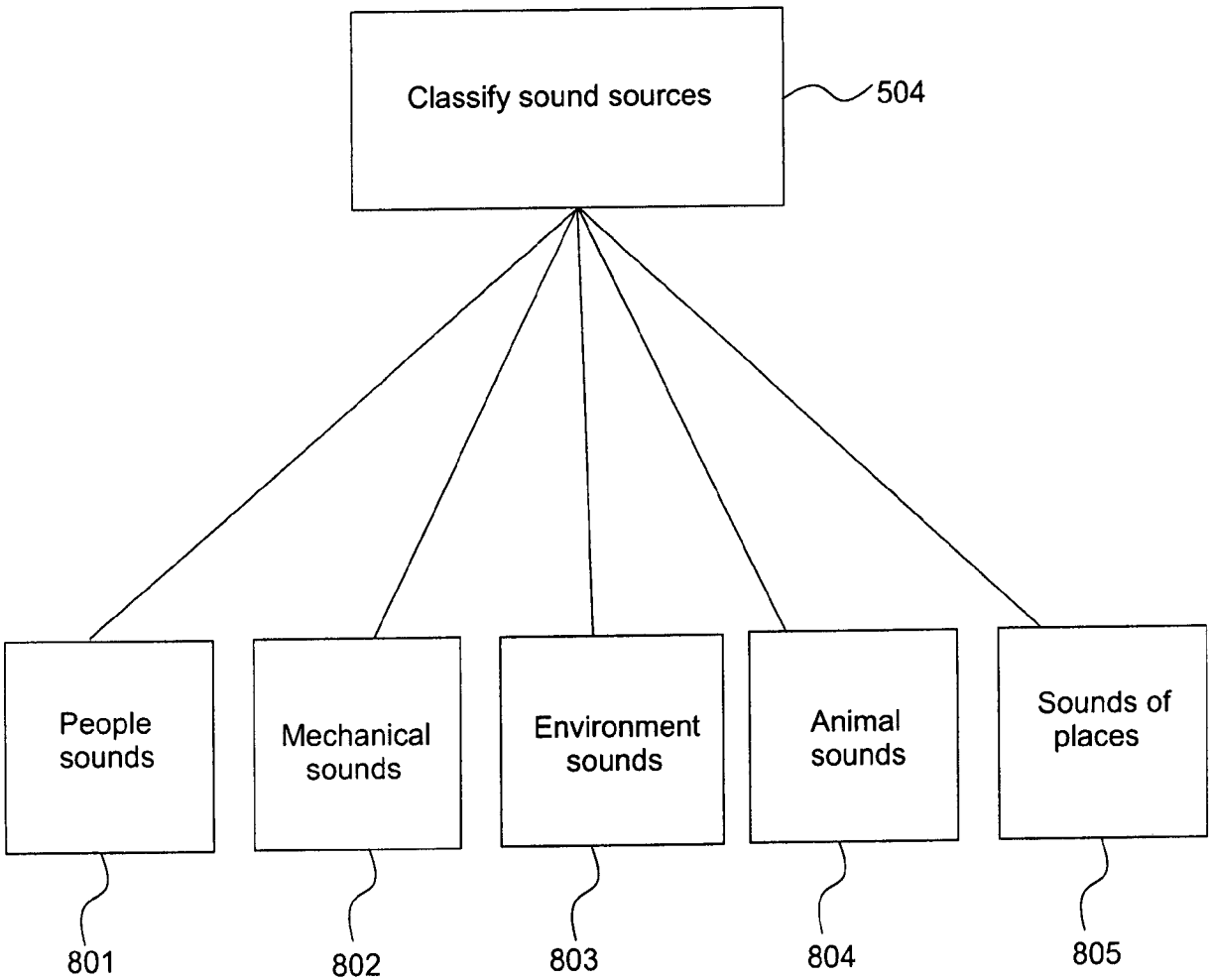
FIG. 8 further details the process illustrated in FIG. 5 of classifying sound sources into, for example, people sounds, mechanical sounds, environmental sounds, animal sounds and sounds associated with places.

The sound source analysis process 205 of application program 201 also includes sound source classification processing as indicated at 504. By classification it is meant processing as regards recognizing different sounds, and classifying those sounds into sounds of similar types. FIG. 8 further details process 504. Processing routines (recognizers) are provided to enable application program 201 to classify sound sources into, for example, people sounds as illustrated at 801, mechanical sounds as illustrated at 802, environmental sounds as illustrated at 803, animal sounds as illustrated at 804 and sounds associated with places as illustrated at 805. Such sound source classification processing can be configured as required according to specific requirements. The disclosure in U.S. Pat. No. 5,918,223 in the name of Muscle Fish and incorporated herein by reference provides details on a reasonable means of performing such classification processing. In particular U.S. Pat. No. 5,918,223 discloses a system for the more detailed classification of audio signals by comparison with given sound signals.

Figure 9:
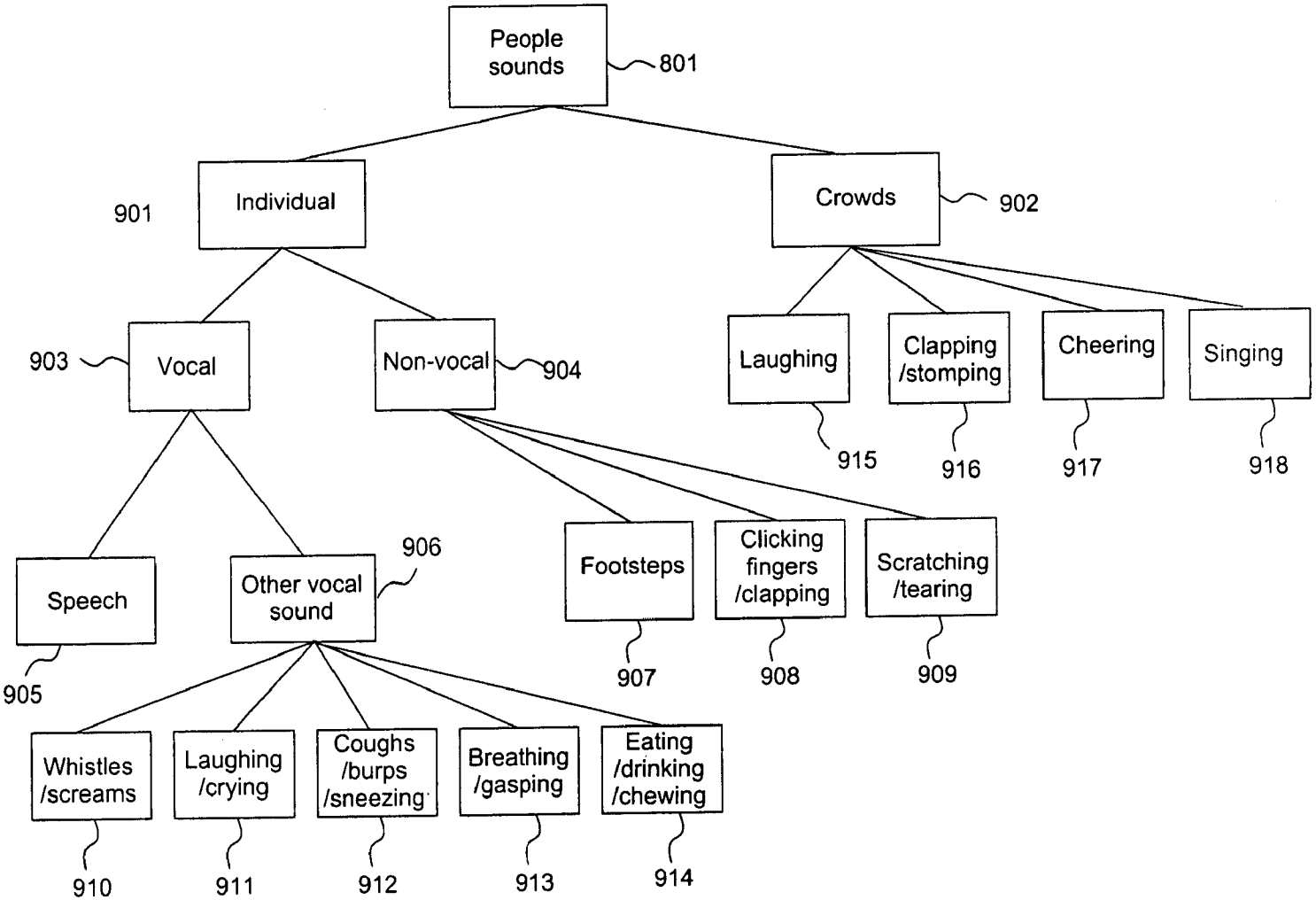

Below are listed various types of sounds that may be recognized. However the lists are not to be considered as exhaustive:

FIG. 9 herein further details types of people sounds that a virtual microphone as configured by application program 201 may be responsive to. Sounds associated with people 801 may be sub-divided into two basic groups, group 901 concerning sounds of individuals and group 902 concerning sounds of groups of people (a group comprising at least two people). Sounds of an individual 901 may be further sub-divided into vocal sounds 903 and non-vocal sounds 904. Vocal sounds 903 may-be further divided into speech sounds 905 and other vocal sounds 906. The sounds included in group 906 may be further sub-divided into whistles and screams as indicated at 907, laughing and crying as indicated at 908, coughs/burps and sneezing as indicated at 909, breathing/gasping as indicated at 910 and eating/drinking/chewing sounds as indicated at 911. The sub-division concerning non-vocal sound at 904 may be sub-divided into sounds of footsteps as indicated at 912, sounds of clicking fingers/clapping as indicated at 913 and scratching/tearing sounds as indicated at 914.

Sounds from crowds 902 may be further sub-divided into laughing sounds as indicated at 915, clapping and/or stomping as indicated at 916, cheering sounds as indicated at 917 and sounds of the people singing as indicated at 918. Application program 201 may be configured to recognize the different types of sounds 901 to 918 respectively. Sounds made by individuals and sounds made by crowds of people are very different as are vocal and non-vocal sounds and therefore application program 201 is, in the best mode contemplated, configured with recognizers for at least these categories.

Figure 10:
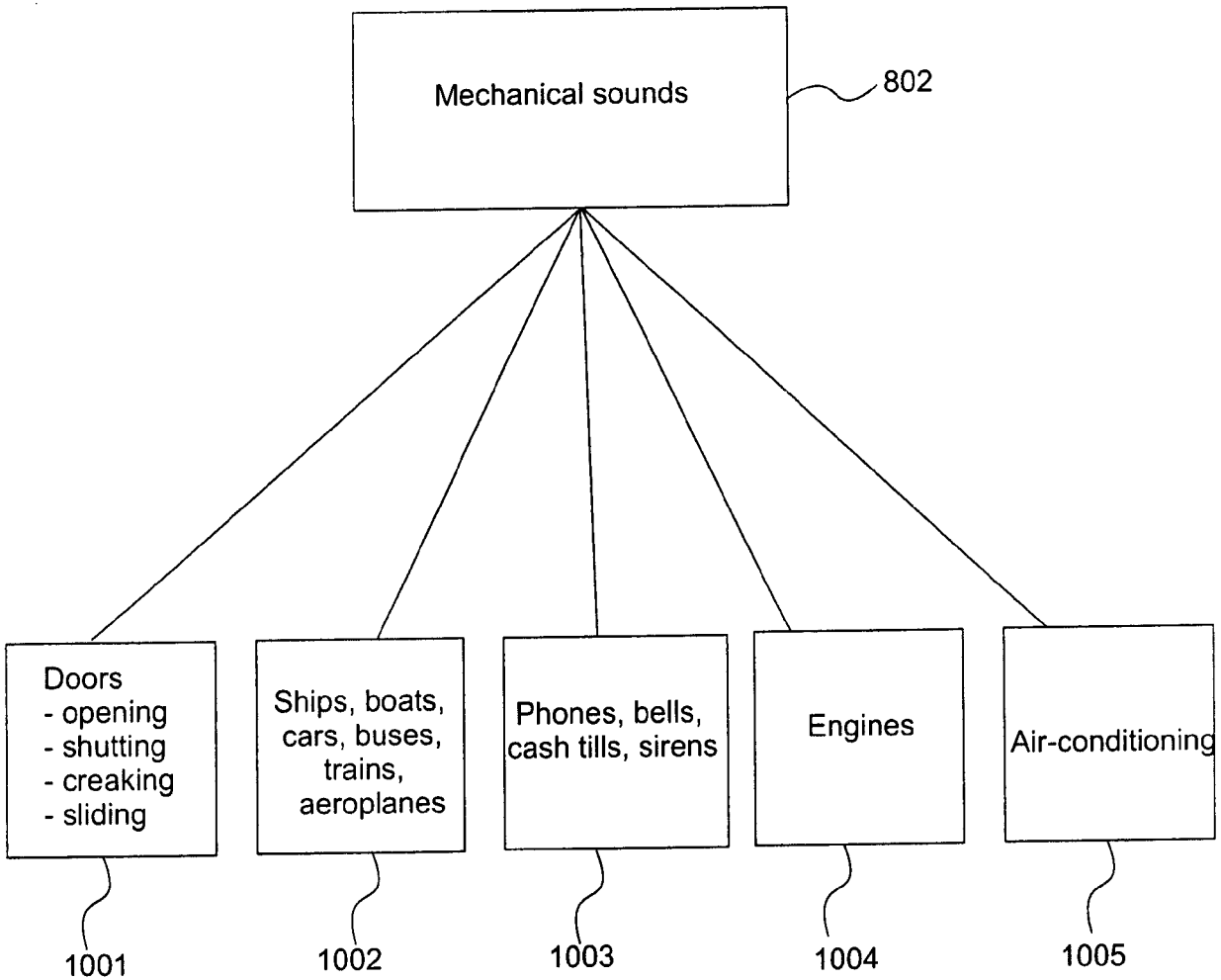

FIG. 10 herein further details types of mechanical sounds that a virtual microphone as configured by application program 201 may be responsive to. Mechanical sounds may be further sub-divided into various groups as indicated. Thus at 1001 sounds of doors opening/shutting/creaking and sliding may be configured as a sound recognizer. Similarly at 1002 the sounds of ships, boats, cars, buses, trains and airplanes are configured to be recognized by application program 201. At 1003 the sounds of telephones, bells, cash-tills and sirens are configured to be recognized by application program 201. At 1004 the sounds of engines of one form or another (such as car engines) are configured to be recognized. Similarly at 1005 the general sound of air-conditioning systems may be included as a recognized sound to be recognized by application program 201.

Figure 11:
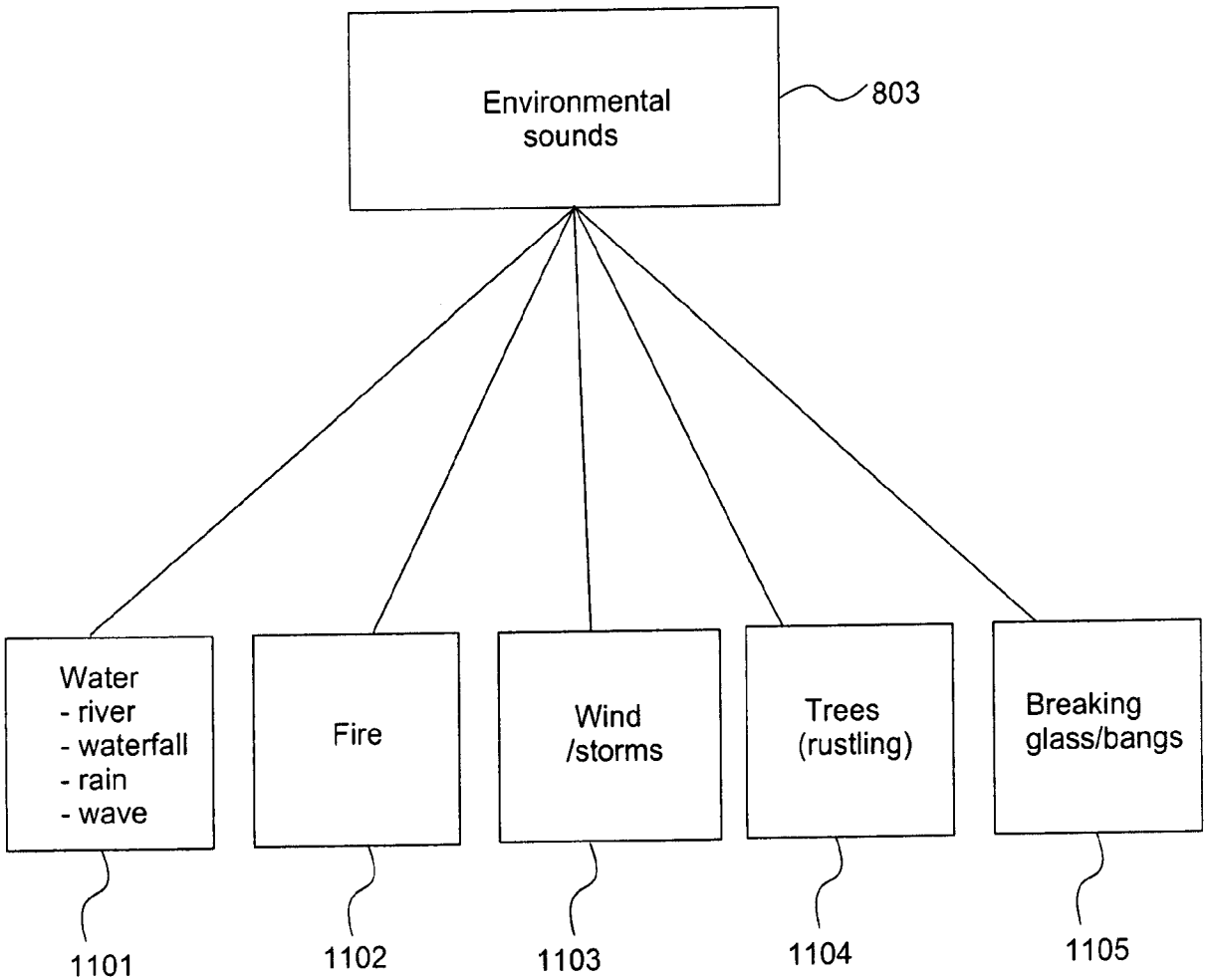

FIG. 11 herein further details types of environmental sounds that a virtual microphone as configured by application program 201 may be responsive to. Types of environmental sounds that may be recognized by a suitably configured recognizer module include water sounds as indicated at 1101 and which could include, for example, the sound of rivers, waterfalls, rain and waves. Other environmental sounds that could be-recognized are fire as indicated at 1102, wind/storms as indicated at 1103, sound of trees (rustling) as indicated at 1104 and the sound of breaking glass or bangs as indicated at 1105.

Figure 12:
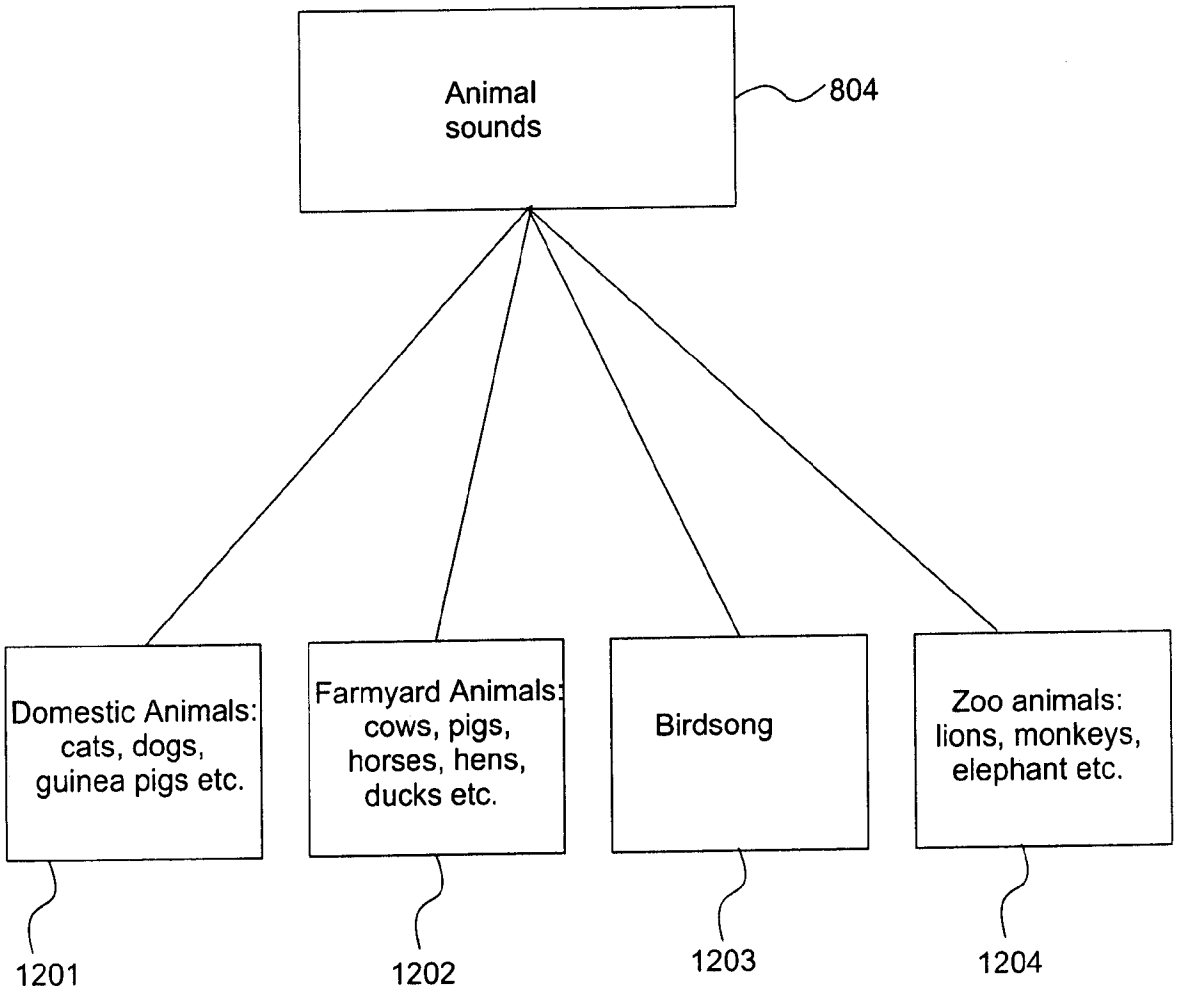

FIG. 12 herein further details a selection of animal sounds that a virtual microphone as configured by application program 201 may be responsive to. Types of animal sounds that may be recognized could be divided into a wide variety of recognizer processing functions. Thus recognizer 1201 may be configured to recognize the sounds of domestic animals, such as cats, dogs, guinea pigs etc. For recognizer 1202 the sounds of farmyard animals including cows, pigs, horses, hens, ducks etc. could be recognized. For recognizer 1203 a processing routine to recognize bird song may be included. Further at 1204 a recognizer configured to recognize zoo animal sounds, such as the sounds of lions, monkeys, elephants etc. may be included.

Figure 13:
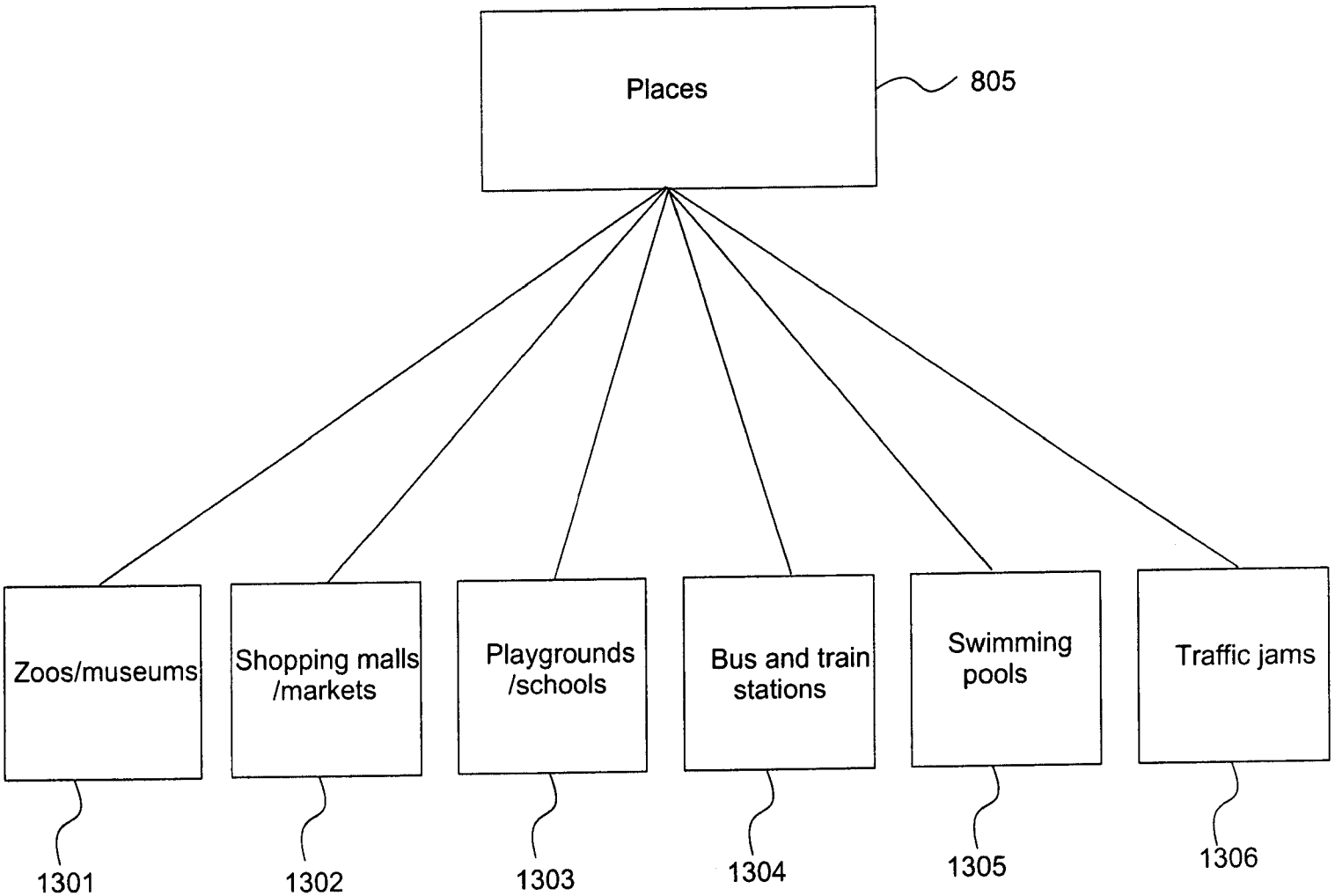

FIG. 13 herein further details types of place sounds that a virtual microphone as configured by application program 201 may be responsive to. Recognizers for recognizing sounds of places can also be provided. At 1301 a recognizer for recognizing sounds of zoos/museums is provided. At 1302 a recognizer is provided for recognizing sounds associated with shopping malls/markets. At 1303 a recognizer is provided for recognizing sounds associated with playgrounds/schools. At 1304 a recognizer is provided for recognizing sounds associated with bus and train stations. At 1305 a recognizer is provided for recognizing sounds associated with swimming pools. Similarly at 1306 a recognizer is provided for recognizing the sounds associated with traffic jams.

Identification of New Sound Sources, Process 505

Application program 201 is, in the best mode contemplated, also provided with means of identifying new sound sources. The loud sounds cause the startle reflex to occur in humans with the result that the loud sound captures the attention of the person. Application program 201 is preferably configured to incorporate processing that mimics the startle reflex so that attention can be drawn to such sounds as and when they occur. The ability of application program 201 to incorporate such processing is made substantially easier with spatial sound because it is known when a new object sound occurs. However a new sound that is different from any sound heard previously will also tend to capture the attention of people. In the best mode some form of recogniser for recognizing sound that differs from anything else heard previously is also provided since sounds that are similar to what has already been heard will be deemed less interesting and will fade from a person's attention.

Determination of Motion of Sound Sources, Process 506

A recognizer configured to determine when sounds are stationary relative to the self (fixed analysis framework) or accompanying the self (moving framework) is important because sound sources can be transient and have no or little interaction with objects in the scene.

The above examples of recognizers are merely given to demonstrate the kinds of sound recognizers that may be implemented in a particular embodiment of application program 201. The number and type of recognizers that may be employed may clearly vary greatly from one system to another and many more examples of recognizers than those discussed above may find useful application depending on particular end-user requirements.

Controlling the path/trajectory of the tour of the virtual microphone; and selecting sound sources supplied on the virtual tour—process 206

Figure 14:
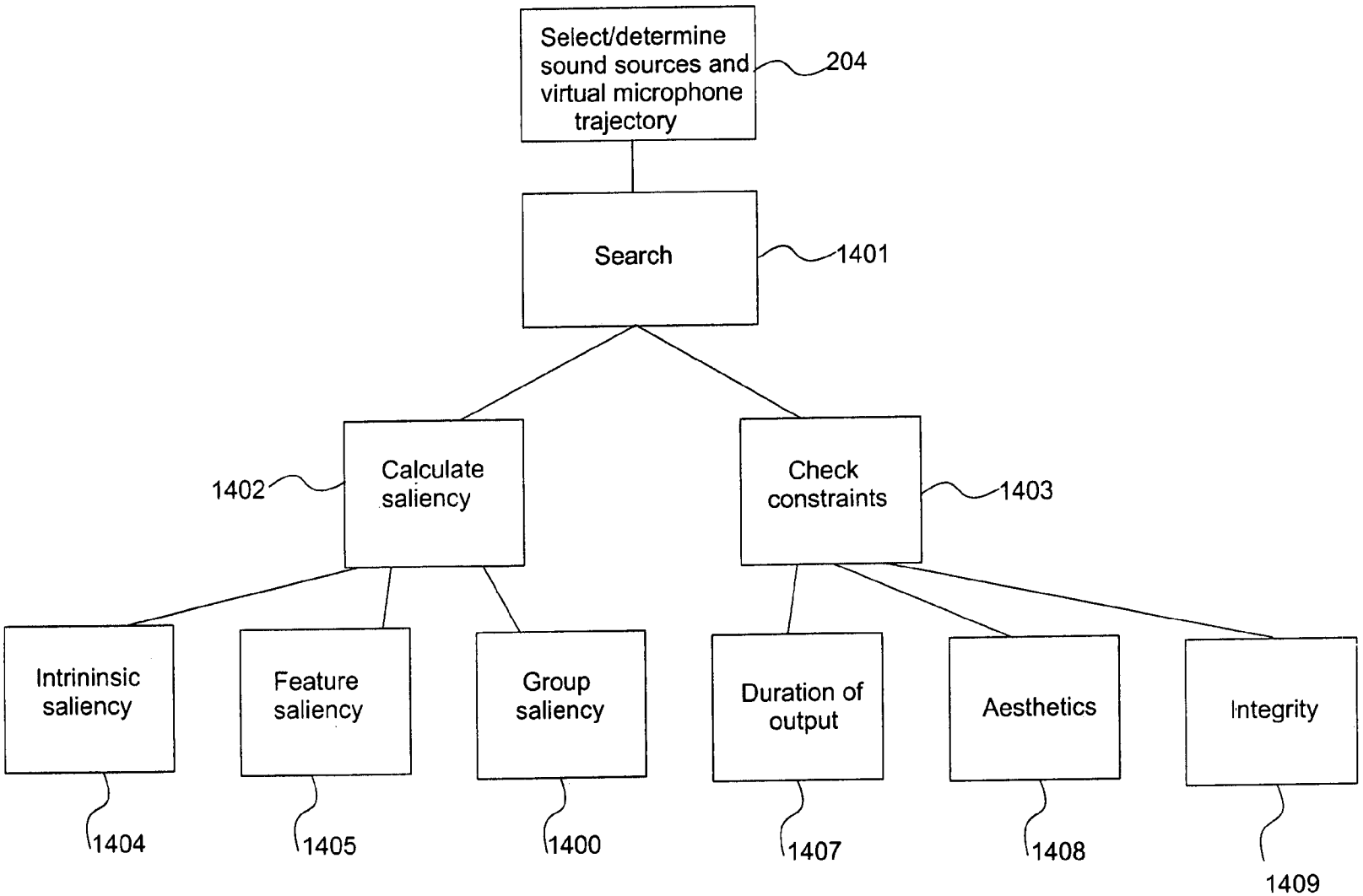
FIG. 14 further details, in accordance with a preferred, process 206 of application program 201 of selecting/determining sound sources and selecting/determining the virtual microphone trajectory.

FIG. 14 herein further details a preferred embodiment of process 206 of FIG. 2 of selecting/determining sound sources and selecting/determining the virtual microphone trajectory for a given virtual microphone.

The matter of selecting sound sources and determining a virtual microphone trajectory in process 206 can be seen as a form of optimisation problem. However an optimal solution is not necessarily required. Rather, for many applications of a suitably configured application program 201, only an acceptable result is required such that the resultant virtual microphone provides a modified version of the sound scene that is aesthetically acceptable to a nominal listener of the resultant edited sound scene. In the preferred embodiment processing in process 206 therefore concerns a search 1401 to find an acceptable result from a number of reasonable candidates that are so produced. The search routines may therefore make use of genetic algorithms and one or more heuristic rules to find possible selections and tours of the virtual microphone about the sound field, the emphasis being to avoid clearly poor or embarrassing resultant processed audio data for use in playback. For example:

when a person is on the move the virtual microphone should be configured by application program 201 to keep around the person;

when a person enters a new environment the virtual microphone should be configured to simulate attention drifting on to new or interesting sound sources nearby;

before zooming in on sound sources in a complex scene an overview of the sound scene should be given before zooming in on particular sound sources that are interesting.

The method described below uses a simple model of a four-dimensional soundscape and does not take into account reflections when the microphone is moved to different positions. For more complex embodiments VRML (Virtual Reality Modelling Language) BIFS (Binary Format for Scene description) may be employed to yield higher quality results as regards the form of the resultant edited sound scene produced.

At process 1402 the saliency of the selected sound sources are maximised over possible virtual microphone trajectories and the sound source selections of process 206. This processing is subject to one or more constraints 1403 that are provided by the style parameters introduced at process 203.

(1) Constraints

The constraints provided by the style parameters ensure that:

the duration of the output sound signal is within certain bounds as indicated at process 1404;

certain aesthetic constraints upon the selections are maintained within certain bounds as indicated at process 1405; and the integrity of the sound sources are respected within certain bounds as indicated at process 1406.

The duration constraint 1404 is the most basic constraint that forces the editing process and it simply ensures that the duration of the selected material is within certain predefined limits.

The most important function of the aesthetic constraint (or constraints) 1405 concerns control of the virtual microphone trajectory. As will be understood by those skilled in the art it would be confusing if the virtual microphone trajectory constantly changed to grab interesting features in the soundscape. Thus the motion of the virtual microphone is required to be damped. Similarly changing the region of reception over time will also cause confusion and therefore this action is also required to be damped. In the best mode an aesthetic constraint is therefore used to impose a smoothness constraint on the virtual microphone trajectory such that jerky virtual microphone movements are given poor scores. In addition other smoothing function aids are preferably employed such as target smoothness values and also predefined tolerances as regards acceptable movements.

Aesthetic constraints and selected style parameters are also required to constrain the balance of features contained within the selection. For example it may be undesirable to produce a resultant edited soundscape that focuses too much on one person and therefore a constraint may be defined and selected for ensuring that resultant edited sound content is provided from a number of people within a group of sound sources. Similarly a suitable constraint may be provided that focuses on a particular person whilst minimising the sounds produced by other members of the group.

Aesthetic and style parameters may also be provided to determine how groups of people are introduced. For example all the people within a group could first be introduced before showing each piecewise or in smaller chunks, or alternatively pieces or chunks may be provided first before showing the group as a whole. Aesthetic constraints may also be provided to determine how background or diffuse sound sources are to be used in a given editing session.

Aesthetic constraints may also be provided to constrain how stock sound sources such as music and background laughter or similar effects should be used. Stock footage can be treated as just another sound source to be used or optimised in the composition. Such footage is independent of the original timeline, and constraints on its use are tied to the edited or selected output signal. However actual ambient sound sources may be treated in the same way by application program 201.

Integrity constraints are required to be provided such that the resulting edited soundscape is, in some sense, representative of the events that occurred in the original soundscape. This would include, for example, a constraint to maintain the original temporal sequence of sound sources within a group and a constraint to ensure that the causality of sounds sources is respected (if one sound causes another then both should be included and in the correct sequence). A suitably configured integrity constraint thus indicates how well a particular virtual microphone trajectory and spatial sound selection respects the natural sound envelopes of the sound sources. It is a matter of style as regards what is scored and by how much. Again tolerances for a target value are preferably defined and used as a constraint in application program 201.

As will be understood by those skilled in the art the types and nature of the particular constraints actually provided in a given application program configured as described herein may vary depending upon the particular requirements of a given user. However an automated or semi-automated system should to be controllable in the sense that the results are predictable to some degree and therefore it will be appreciated that a fully automatic system may provide less freedom to make interesting edits than one which enables an operator to make certain choices.

(2) Saliency

In the preferred embodiment illustrated schematically in FIG. 14 saliency is calculated as the sum of three components:

i. The intrinsic saliency of the waveforms of each sound source, 1407;

ii. The saliency of recognised features in each sound source, 1408; and iii. The saliency of certain sound sources when the sources are grouped together, 1409.

All three components of saliency 1407-1409 will be affected by the trajectory (the variation in position and orientation with time) of both the sound source and the virtual microphone. This is because the sound intensity received by the microphone, even in the simplest models (i.e. those ignoring room acoustics), varies in accordance with the inverse square law. In other words the intensity is inversely proportional to the distance between the microphone and the sound source. All the component types of saliency are actually calculated over an interval of time and most forms of saliency should be affected by the style parameters. Since the saliency of sound is defined over intervals of time the application program 201 is required to determine the set of intervals for which each sound source is selected and then sum the resultant saliencies for each sound source over these intervals.

Intrinsic Saliency for the Interval

Intrinsic saliency derives from the inherent nature of a sound source waveform. It may comprise loudness (the human perception of intensity), the presence of rhythm, the purity of the pitch, the complexity of the timbre or the distribution of frequency.

Figure 15:
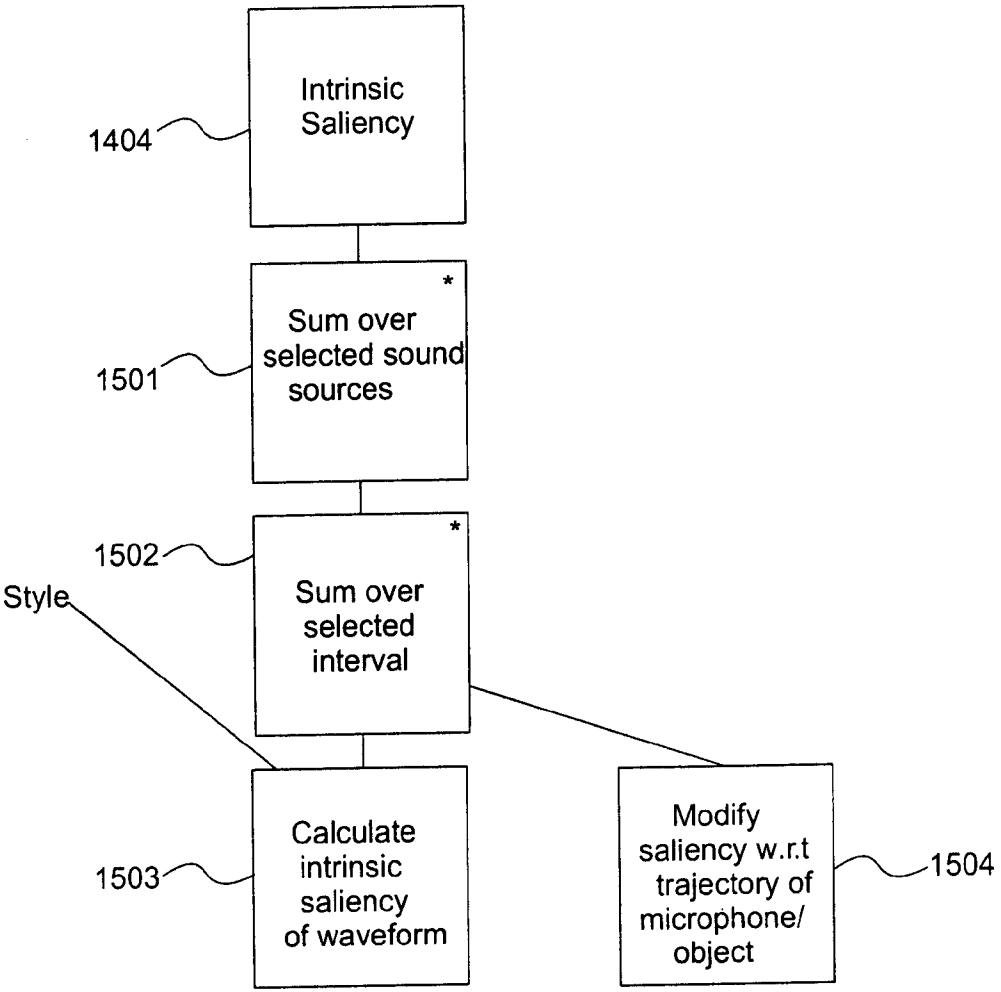
FIG. 15 further details process 1407 of FIG. 14 of calculating intrinsic saliency of sound sources.

FIG. 15 herein further details processing process 1407 of FIG. 14 of calculating intrinsic saliency. At process 1501 application program 201 is configured to sum the intrinsic saliency for a predefined interval over all sound sources. Following process 1501, application program 201 is then set to sum the intrinsic saliencies over selected intervals wherein the sound source under consideration is always selected. The single interval saliency is, in the best mode contemplated by the inventors, based upon the purity of the waveform and the complexity of the timbre. It may however be based on various other additional features such as the loudness of the sound source. At process 1503 the processed data produced by process 1502 is modified by a multiplier that is determined by the trajectories of the sound source and the virtual microphone over the interval. Following processes 1502 and 1503 the intrinsic saliency of the waveform is then calculated at process 1504 in accordance with the one or more style parameters that were selected or determined at process 203 in the main pipeline of application program 201.

Recognised Feature Based Saliency for the Interval

Feature based saliency is based upon some a priori interest in the presence of particular features within the interval. However features will have their own natural time interval and thus it is a requirement that the saliency interval includes the interval of the feature. The impact of each feature on the whole interval is affected by the relative duration of the feature and overall intervals. The features are detected prior to the search procedure 1401 by pattern recognition recogniser functions of the type described in relation to FIGS. 8-13 and configured to detect characteristics such as, for example, laughter, screams, voices of people etc.

Figure 16:
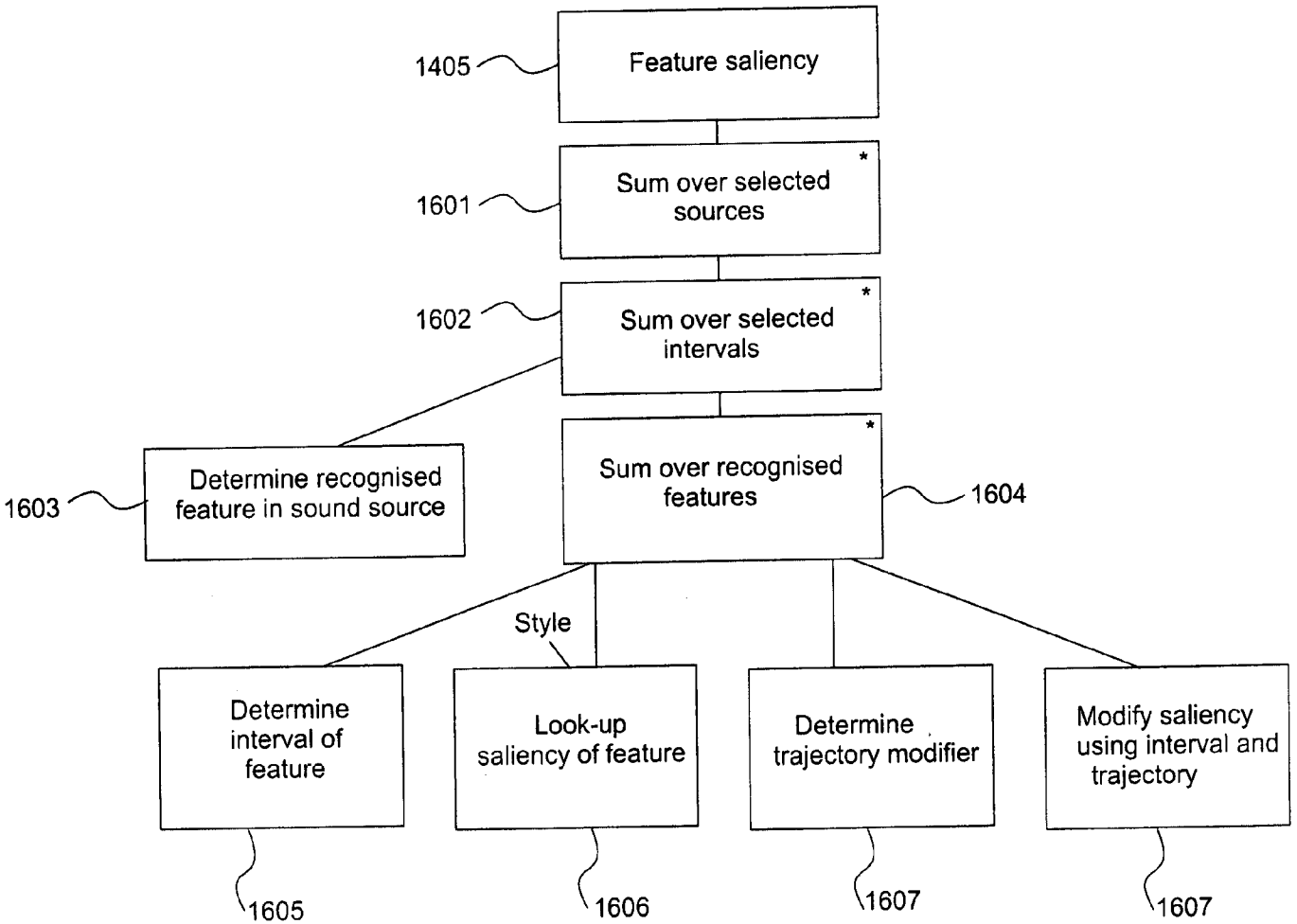
FIG. 16 further details process 1408 of FIG. 14 of calculating feature saliency of sound sources.

FIG. 16 herein further details process 1408 of FIG. 14 of calculating feature saliency of sound sources. At process 1601 application program 201 is configured to sum feature saliency over the selected sources. Following process 1601, at process 1602 the application program is set to sum the feature saliencies over selected intervals wherein a feature has been determined to be recognized as indicated by sub-process 1603. The features recognized are determined by the aforementioned recognizer processing routines applied to the whole interval and returning a sub-interval where a characteristic or feature of the sound signal has been recognized. Following processes 1602 and 1603, at process 1604 application program 201 is then configured to sum over the recognized features by undertaking the following processing processes. At process 1605 process 1604 determines the interval where the recognized feature occurs and at process 1606 a table look-up is performed to determine the saliency of the feature. At process 1607 a trajectory modifier is determined and then at process 1608 the saliency, that is the inherent feature interest, is then modified by (a) multiplying the saliency by a factor determined by the whole interval and the interval during which the feature occurs, and (b) multiplying again by the saliency trajectory modifier as calculated at process 1607.

Group Based Saliency for the Interval

The group based saliency is composed of an intrinsic saliency and a feature based saliency. A group's saliency in an interval is determined either by some intrinsic merit of the group's composite sound waveform or because the group is recognised as a feature with its own saliency. The group feature is required to place value upon interaction between different or distinct sound sources, such as capturing a joke told by a given person at a dinner table as well as capturing the resulting laughter. Thus the group feature should be configured to value causality between sound sources provided that they are similar according to some Gestalt measure and, in particular, providing that the sound sources are close in space and in time.

Figure 17:
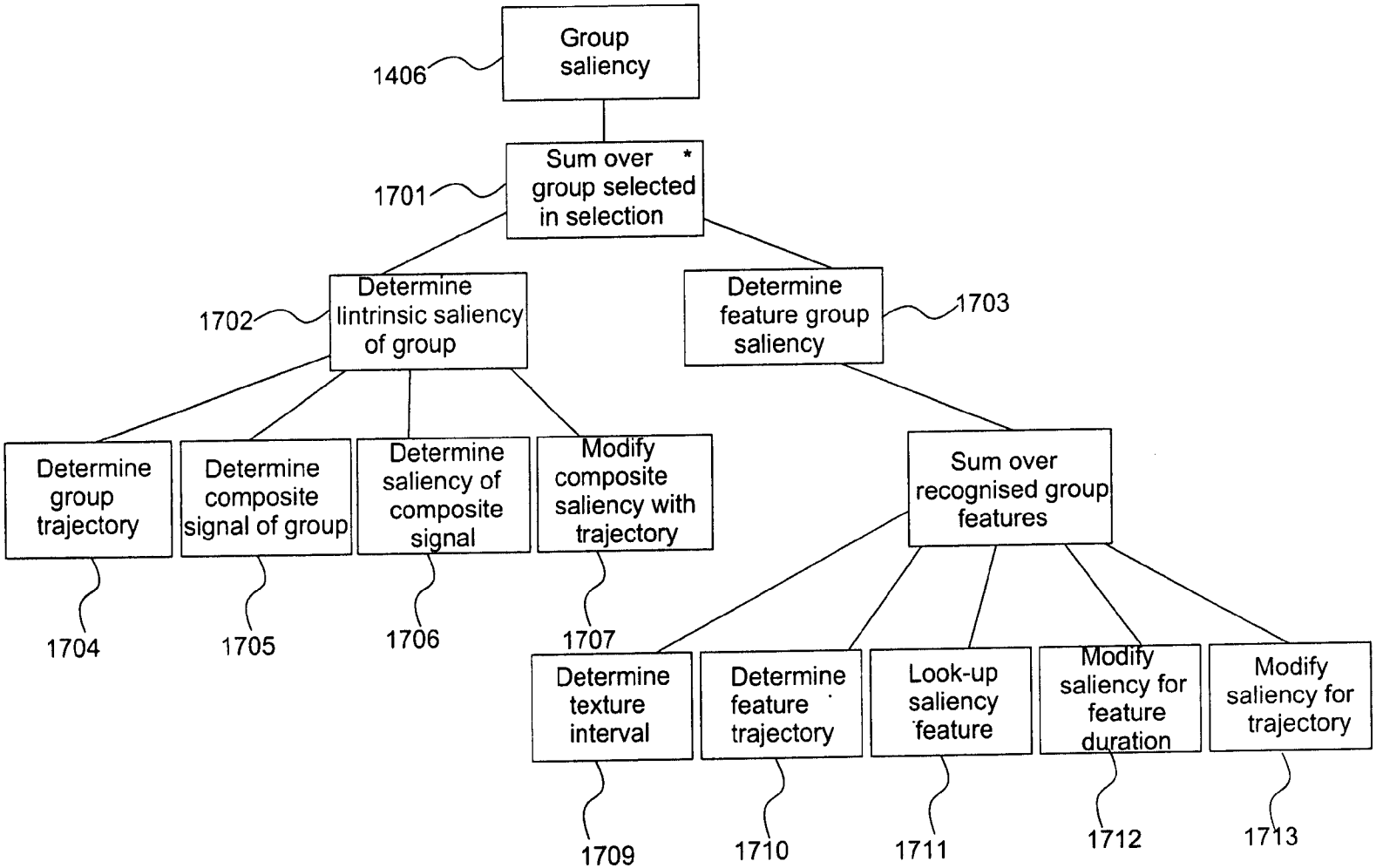
FIG. 17 further details process 1409 of FIG. 14 of calculating group saliency of sound sources.

FIG. 17 herein further details process 1409 of FIG. 14 of calculating group saliency of sound sources. At process 1701 application program 201 is configured to sum over the group selected in the selection process 206. Following process 1701, the intrinsic saliency of the group is determined at process 1702 and the feature group saliency is determined at process 1703. The intrinsic saliency for the group (rather than for an identified sound source) composes the sounds of the group into one representative sound signal and calculates a representative trajectory. At process 1704 the trajectory of the group is determined. Following process 1704 at process 1705 the composite signal of the group is determined and at process 1706 the saliency of the composite signal obtained in process 1705 is determined. Following processes 1704-1706 the composite saliency calculated at process 1706 is then modified at process 1707 with the trajectory that was determined at process 1704.

Process 1703 concerns determination of feature group saliency. Since a group can have a number of features that are significant for saliency purposes then application program 201 is required to sum over all such features in the interval as indicated at process 1708. Following summing at process 1708, the texture interval is determined at process 1709. Then at process 1710 the feature trajectory is determined. At process 1711 a table look-up for the saliency of the feature is performed whereafter at process 1712 the saliency obtained is modified to take account of the actual feature duration. Following process 1712, at process 1713 the saliency determined at processes 1711 and 1712 is then further modified for the feature trajectory determined at process 1710.

Saliency processing may be based on one or a number of approaches, but in the best mode it is based partly on a psychological model of saliency and attention. An example of such a model that may form a good basis for incorporating the required processing routines in application program 201 is that described in the PhD by Stuart N. Wrigley: "A Theory and Computational Model of Auditory Selective Attention", August, 2002, Dept. of Computer Science, University of Sheffield, UK which is incorporated herein by reference. In particular Chapter 2 of this reference discloses methods for and considerations to be understood in auditory scene analysis, Chapter 4 provides details pertaining to auditory selective attention and Chapter 6 describes a computational model of auditory selective attention. In addition various heuristic based rules and probabilistic or fuzzy based rules may be employed to decide on which sound sources to select, to what extent given sound sources should be selected and also to determine the virtual microphone characteristics (trajectory and/or field of reception) at a given time.

The search procedure of the audio rostrum effectively guesses a virtual microphone trajectory and spatial sound selection and scores its saliency and ensures that it satisfies the various constraints on its guesses. The search continues until either sufficiently interesting guesses have been found or some maximum number of guesses have been made. In the preferred embodiment a brute force search operation is used to obtain a set of acceptable guesses that utilises no intelligence except for that provided by way of the rules that score and constrain the search. However multi-objective optimisation might be used to use some of the constraints as additional objectives. There are many approaches to making the guesses that can be used. Other examples that may complement or replace the optimisation approach include: use of genetic algorithms and use of heuristics. In the case of using heuristics a template motion for the virtual microphone motion could be used for example. The template would be defined relative to an actual microphone's position and might recognise particular phases of the microphone motion.

Alternative Approach to Determining Sound Sources and Virtual Microphone Trajectory (Process 206)

In an alternative of the aforementioned embodiment, the search/optimization method of determining sound sources and a virtual microphone trajectory may be simplified in various ways. One such method is to utilize the concept of index audio clips for intervals of sound. An index audio clip may be considered to represent a "key" spatial sound clip that denotes a set of spatial sound sources selected for a particular time interval. In this way a key part of the audio may be determined as a set of sound sources to focus on at a particular time. The virtual microphone may then be placed in a determined position such that the position enables the set of sound sources to be recorded (the virtual microphone being kept stationary or moving with the sound sources). By using index audio clips in this way the search problem is therefore reduced to picking the position of a fixed virtual microphone for each key spatial sound clip selection and then managing the transitions between these key sound clips. However it would also be required to permit operation of application program 201 such that the virtual microphone is allowed to accompany a group of moving sound sources. In this case the relative position of the virtual microphone would be fixed with respect to the group of sound sources, but again the absolute position of the virtual microphone would need to be fixed.

Using index audio clips leads to a heuristic based algorithm to be employed by application program 201 as follows:

1. Determine a set of index audio clips by identifying and selecting a set of sound sources within a common interval (for example, using sound source recognition processes of the type illustrated schematically in FIG. 8);

For each index audio clip calculate a virtual microphone trajectory that would most suitably represent the selected sound sources. This determines the field of reception of the virtual microphone and it's position during the interval. It should be noted that the virtual microphone might well be configured by application program 201 to track or follow the motion of the sound sources if they are moving together; determine a spatial sound selection for each index audio clip; and determine the nature of the audiological transitions between the key spatial sound clips (from one index audio clip to the next).

Process 4 above concerns the determination of the nature of the transitions may be achieved by panning between the virtual microphone positions or by moving to a wide field of view that encompasses fields of reception for two or more virtual microphones. Furthermore it should be appreciated that if the index audio clips are temporally separated then a need to cut or blend between sound sources that occurred at different times would arise.

It will be understood by those skilled in the art that the order in which the clips are visited need not follow the original sequence. In this case application program 201 should be provided with an extra process between processes 1 and 2 as follows:

1b. Determine the order in which the index frames are to be used.

Rendering or Mixing the Sound Sources, Process 207

The main rendering task is that of generating the sound signal detected by a virtual microphone (or a plurality of virtual microphones) at a particular position within the sound field environment. Thus in the case of a sound field sampled by using physical microphones a virtual microphone would be generated by application program 201 in any required position relative to the actual microphones. This process may be considered to comprise a two-stage process. In the first stage the selections are applied to obtain a new spatial sound environment composed only of sound sources that have been selected, and defined only for the interval that they were selected. The selected spatial sound may thus have a new duration, a new timeline, and possibly new labels for the sound sources. Furthermore additional sound sources can be added in for effect (e.g. a stock sound of background laughter). In the second stage the virtual microphone trajectory is applied to the selected spatial sound to output a new sound signal that would be output by a virtual microphone following a given calculated trajectory. This process takes into account the inverse square law and also introduces a delay that is proportional to the distance between the sound source and the virtual microphone.

As mentioned earlier the audio rostrum can be seen as a function 206 taking a style parameter and spatial sound and returning a selection of the spatial sound sources and a virtual microphone trajectory. The selection is simply a means of selecting or weighting particular sound sources from the input spatial sound. Conceptually the selection derives a new spatial sound from the original and the virtual microphone trajectory is rendered within this spatial sound.

Rendering process 207 is very important for getting realistic results. For example acoustic properties of the 3D environment need to be taken into account to determine the reflections of the sound. When the spatial sound is determined (for example from using a microphone array) then distinguishing the direct sound sources from reflections is important. If the reflection is seen as a distinct sound source then moving a virtual microphone towards it will mean changing the intensity of the reflection and changing the delay between the two sources, perhaps allowing the reflection to be heard before the direct sound signal.

As will be appreciated by those skilled in the art there are numerous known methods that may suitably be employed to perform one or more aspects of the required rendering. Examples of such systems, incorporated herein by reference, include:

- U.S. Pat. No. 3,665,105 in the name of Chowning which discloses a method and apparatus for simulating location and movement of sound through controlling the distribution of energy between loud speakers;
- U.S. Pat. No. 6,188,769 in the name of Jot which discloses an environmental reverberation processor for simulating environmental effects in, for example, video games; and
- U.S. Pat. No. 5,544,249 in the name of Opitz, which discloses a method of simulating a room and/or sound impression.

Additionally those skilled in the art will appreciate that the rendering system could be configured to utilise MPEG4 audio BIFS for the purpose of defining a more complete model of a 3D environment having a set of sound sources and various acoustic properties. However for many it will suffice to rely on a relatively simple form of 3D model of acoustics and sound sources. This is particularly so if arbitrary motion of the virtual microphone from the original sound capture microphones is not allowed. These simpler approaches effectively make crude/simple assumptions about the nature of a 3D environment and its acoustics.

The difficulties in providing physically realistic rendering when using a simple acoustical model imposes practical constraints upon how far the virtual microphone is allowed to move from the actual microphones that captured the spatial sound. It will be understood by those skilled in the art that these constraints should be built into the search procedure 206 for the spatial sound selections and virtual microphone trajectory.

A useful reference that addresses many of the relevant issues pertaining to the rendering process and which is incorporated herein by reference is "ACM Siggraph 2002 course notes 'Sounds good to me!' Computational sound for graphics, virtual reality and interactive systems" Thomas Funckerhouser, Jean Marc Jot, Nicolas Tsingos. The main effects to consider in determining a suitable 3D acoustical model are presented in this reference including the effect of relative position on such phenomena as sound delay, energy decay, absorption, direct energy and reflections. Methods of recovering sound source position are discussed in this reference based on describing the wavefront of a sound by its normal. The moving plane is effectively found from timing measurements at three points. To determine spatial location three parameters are required such as, for example, two angles and a range. The effects of the environment on sounds are also considered and these are also important in configuring required processing for rendering process 207. For instance reflections cause additional wavefronts and thus reverberation with resultant "smearing" of signal energy. The reverberation impulse response is dependent upon the exponential decay of reflections which, in turn, is dependent upon:

- frequency of the sound(s)—there is a greater degree of absorption at higher frequencies resulting in faster decay;
- size of the sound field environment—larger rooms are associated with longer delays and therefore slower decay of sound sources.

Normally the sound heard at a microphone (even if there is only one sound source) will be the combination or mixing of all the paths (reflections). These path lengths are important because sound is a coherent waveform phenomenon, and interference between out of phase waves can be significant. Since phase along each propagation path is determined by path length then path length needs to be computed to an accuracy of a small percentage of the wavelength. Path length will also introduce delay between the different propagation paths because of the speed of sound in air (343 meters per second).

The wavelength of audible sound ranges from 0.02 to 17 meters (20 khz and 20Hz). This impacts the spatial size of objects in an environment that are significant for reflection and diffraction. Acoustic simulations need less geometric detail because diffraction of sound occurs around obstacles of the same size as wavelength. Also sound intensity is reduced with distance following the inverse square law and high frequencies also get reduced due to atmospheric scattering. When the virtual microphone is moving relatively to the sound source, there is a frequency shift in the received sound compared to the how it was emitted. This is the well-known Doppler effect.

The inverse square law and various other of the important considerations for effective rendering are more fully discussed below.

Inverse Square Law and Acoustic Environments

As has already been indicated the rendering process of process 207 is required to be configured to take account of the decay of sound signals based on the inverse square law associated with acoustic environments. Also a delay has to be introduced to take account of the time for the sound to travel the distance from the sound source to the virtual microphone. In a simple environment (i.e. ignoring reverberations) then a microphone placed equidistant between two sound sources would capture each sound proportional to the relative intensity of the original sound sources. The important properties of acoustic environments and of the effects of the inverse square law that require consideration for providing acceptable rendering processing 207 are briefly summarised below.

The acoustical field of a sound source depends upon the geometry of the source and upon the environment. The simplest sound source is the monopole radiator which is a symmetrically pulsating sphere. All other types of sound sources have some preferred directions for radiating energy. The physical environment in which sounds are created effects the sound field because sound waves are reflected from surfaces. The reflected waves add to the direct wave from the source and distort the shape of the radiating field.

The simplest environment, called a free-field, is completely homogenous, without surfaces. Free-field conditions can be approximated in an anechoic room where the six surfaces of the room are made highly absorbing so that there are no reflections, alternatively in an open field with a floor that does not reflect sound.

A monopole radiator expands and contracts, respectively causing, over-pressure and partial vacuum in the surrounding air. In the free-field environment the peaks and troughs of pressure form concentric spheres as they travel out from a source.

The power in the field a distance r away from the source is spread over the surface of the sphere with an area 4πr2. It follows that for a source radiating acoustical power P, the intensity I is given by:

$$I=P/4\pi r2$$

This is the inverse square law for the dependence of sound intensity on distance.

If the source is not spherically symmetric then in a free field, the intensity, measured in any direction with respect to the source is still inversely proportional to the square of the distance, but will have a constant of proportionality different than ¼π that is affected by direction. Furthermore the area over which a microphone captures sounds will also affect the outcome.

Atmospheric Scattering

This is another form of attenuation of sound intensity that affects higher frequencies. The attenuation of propagating acoustic energy increases as a function of:

increasing frequency, decreasing temperature and decreasing humidity. For most sound fields atmospheric absorption can be neglected, but it becomes increasingly important where long distances or very high frequencies are involved. The following reference, incorporated herein by reference, provides further details on atmospheric considerations to be taken account of in the rendering process: Cyril Harris, "Absorption of Sound in Air versus Humidity and Temperature," Journal of the Acoustical Society of America, 40, p. 148.

Döppler Shifting

This concerns the effect of relative motion between sound sources and virtual microphones that are be built into the rendering process if realistic edited sound is to be produced. When a sound source s and or a receiver r are moving relative to one another, sound waves undergo a compression or dilation in the direction of the relative speed of motion. This compression or dilation modifies the frequency of the received sound relative to the emitted sound in accordance with the well known Döppler equation:

$$Fr/Fs=(1-(n.Vr/c))/(1-(n.Vs/c))$$

where Vs is the velocity of the source, Vr is the velocity of the receiver, Fr is the frequency of the received sound, Fs is the frequency of the sound emitted from a source and n is the unit vector of the direction between source and receiver.

Alternatives to using a full acoustical model of the environment and sound path tracing are based upon statistical characterisations of the environment. For example in the case of providing artificial reverberation algorithms wherein the sound received is a mixture of the direct signal, some relatively sparse "early reflections" and a set of dense damped reflections, these are better modelled statistically than through sound path tracing or propagation. These techniques are complementary to path tracing approaches.

From the above discussion pertaining to the difficulties associated with providing optimal spatial sound rendering it will be appreciated that use of plausible solutions or approximations may in many cases suffice to provide an acceptable rendering solution.

Process 206: Pre-Processing of the Sound Field

Application program 201 may be configured to operate with an additional processing process in the aforementioned processing pipeline. The recorded spatio-temporally characterised sound scene may itself be pre-processed by way of performing selective editing on the recorded sound scene. In this way there is generated a modified recorded sound scene for the subsequent selection processing (206) and rendering (207) processes to process. This of course results in the at least one generated virtual microphone being configurable to move about the modified recorded sound scene. Selective editing may be a desirable feature in configuring application program 201 for use by certain end users. By selective editing it is meant provision of a means of cutting out material from the recorded sound scene. It may be configured to remove particular intervals of time (temporal cutting) and/or it may remove sound sources from an interval (sound source cutting).

The selective editing functionality may also be used to re-weight the loudness of the spatial sound sources rather than simply removing one or more sound source. In this way particular sound sources may be made less (or more) noticeable. Re-weighting is a generalisation of selection where a value of 0 means cut out the sound source and 1 means select the sound source. Values between 0 and 1 may be allocated to make a sound source less noticeable and values greater than 1 may be allocated to make a particular sound source more noticeable. It should be noted that the selection (or reweighting) will vary over time. i.e. the original sound source may be made silent in one instance and be made louder in another. Temporal cutting may be considered to be equivalent to switching the virtual microphone off (by making it unreceptive to all sounds). However this would still leave sound source cutting and re-weighting.

Collectively processing processes 205-207 thereby result in processor 102 generating a set of modified audio data for output to an audio player. One or a plurality of virtual microphones are generated in accordance with, and thereby controlled by, the characteristic sounds identified in the analysis of the sound sources. The modified audio data may represent sound captured from one or a plurality of virtual microphones that are configurable to be able to move about the recorded sound scene. Furthermore motion of the virtual microphones may of course comprise situations where they are required to be stationary (such as, for example, around a person who does not move) or where only the field of reception changes.

Although the aforementioned preferred embodiments of application program 201 have been described in relation to processing of sound sources of a spatially characterised sound field it should be remembered that the methods and apparatus described may be readily adapted for use in relation to spatially characterised sound that has been provided in conjunction with still or moving (video) images. In particular a suitably configured application program 201 may be used to process camcorder type video/spatial sound data such that the one or more virtual microphones thus created are also responsive to the actual image content to some degree. In this respect the methods and apparatus of European patent publication no. EP 1235182 in the name of Hewlett-Packard Company, incorporated herein by reference (and which may suitably be referred to as the auto-rostrum), find useful application in conjunction with the methods and apparatus described herein. The skilled person in the art will see that the following combinations are possible:

A virtual microphone application program controlled fully or in part by the sound content as substantially described herein before; and A virtual microphone application program controlled to some degree by the image content of image data associated with the sound content.

The disclosure in European patent publication no. EP 1235182, concerns generation of "video data" from static image data wherein the video is generated and thereby controlled by determined characteristics of the image content itself. The skilled person in the art will therefore further appreciate that the methods and systems disclosed therein may be combined with a virtual microphone application program as described herein. In this way image data that is being displayed may be controlled by an associated sound content instead of or in addition to control actuated purely from the image content.

For applications where audio data is associated with image data the process of generating the virtual microphone comprises synchronising the virtual microphone with the image content. The modified audio data (representing the virtual microphone) is used to modify the image content for display in conjunction with the generated virtual microphone. In this way the resultant displayed image content more accurately corresponds to the type of sound generated. For example if the sound of children laughing is present then the image actually displayed may be a zoom in on the children.

Similarly for applications where the audio data is associated with image data and the process of generating the virtual microphone comprises synchronising the virtual microphone with identified characteristics of the image content. Here the identified image content characteristics are used to modify the audio content of the generated virtual microphone.

The specific embodiments and methods presented herein may provide an audio rostrum for use in editing spatial sound. The audio rostrum operates a method of editing a spatio-temporal recorded sound scene so that the resultant audio represents sound captured from at least one virtual microphone generated in accordance with, and thereby controlled by, identified characteristic sounds associated with the sound scene.

At least one virtual microphone is generated, which is configurable to move about a spatio-temporally recorded sound scene. The degree of psychological interest in the sound to a listener of the sound represented by the virtual microphone may thereby be enhanced.

There may be provided a method and system for generating a virtual microphone representation of a spatial sound recording that has been recorded by a spatial sound capture device.

There may be provided a method and system for generating a virtual microphone representation of a spatial sound capture device sound recording such that the frame of reference of the virtual microphone representation is rendered to be stationary with respect to the movements of the spatial sound capture device.

There may be provided a method and system for generating a virtual microphone representation of a spatial sound capture device sound recording such that the frame of reference of the virtual microphone representation is rendered to move relative to particular sound sources.

There may be provided a method and apparatus for generating a virtual microphone representation of a spatial sound capture device sound recording such that the virtual microphone is rendered to move closer to, or further away from, particular sound sources.

There may be provided an audio processing method and system configured to process complex recorded spatial sound scenes into component sound sources that can be consumed piecewise.

There may yet further be provided a method of editing of a spatio-temporal recorded sound scene, so that the resultant audio represents sound captured from at least one virtual microphone generated in accordance with, and thereby controlled by, identified characteristic sounds associated with the sound scene and identified image content characteristics of an associated digital image.

Optionally a soundscape as described herein may be recorded in conjunction with still or moving (video) images.

As noted above, according to one exemplary embodiment, there is provided a method of processing audio data, the method comprising: characterising an audio data representative of a recorded sound scene into a set of sound sources occupying positions within a time and space reference frame; analysing the sound sources; and generating a modified audio data representing sound captured from at least one virtual microphone configured for moving about the recorded sound scene, wherein the virtual microphone is controlled in accordance with a result of the analysis of the audio data, to conduct a virtual tour of the recorded sound scene.

Embodiments may further comprise identifying characteristic sounds associated with the sound sources; and controlling the virtual microphone in accordance with the identified characteristic sounds associated with the sound sources.

Embodiments may further comprise normalising the sound signals by referencing each the sound signal to a common maximum signal level; and mapping the sound sources to corresponding the normalised sound signals.

Embodiments may further comprise selecting sound sources which are grouped together within the reference frame.

Embodiments may further comprise determining a causality of the sound sources.

Embodiments may further comprise recognizing sound sources representing sounds of a similar classification type.

Embodiments may further comprise identifying new sounds which first appear in the recorded sound scene and which were not present at an initial beginning time position of the recorded sound scene.

Embodiments may further comprise recognizing sound sources which accompany self reference point within the reference frame.

The embodiment may further comprise recognizing a plurality of pre-classified types of sounds by comparing a waveform of a the sound source against a plurality of stored waveforms that are characteristic of the pre-classified types.

Embodiments may further comprise classifying sounds into sounds of people and non-people sounds.

Embodiments may further comprise grouping the sound sources according to at least one criterion selected from the set of: physical proximity of the sound sources; and similarity of the sound sources.

In the various embodiments, generating modified audio data may further comprise executing an algorithm for determining a trajectory of the virtual microphone followed with respect to the sound sources, during the virtual tour.

In the various embodiments, generating a modified audio data may further comprise executing an algorithm for determining a field of reception of the virtual microphone with respect to the sound sources.

In the various embodiments, modified audio data may further comprise executing a search algorithm comprising a search procedure for establishing a saliency of the sound sources.

In the various embodiments, generating a modified audio data may further comprise a search procedure, based at least partly on the saliency of the sound sources, to determine a set of possible virtual microphone trajectories.

In the various embodiments, generating a modified audio data may further comprise a search procedure, based on the saliency of the sound sources, to determine a set of possible virtual microphone trajectories, the search being constrained by at least an allowable duration of a sound source signal output by the generated virtual microphone.

In the various embodiments, generating a modified audio data may further comprise a search procedure, based on the saliency of the sound sources, to determine a set of possible virtual microphone trajectories, the search procedure comprising a calculation of: an intrinsic saliency of the sound sources; and at least one selected from the set comprising: a feature-based saliency of the sources; and a group saliency of a group of the sound sources.

In the various embodiments, analysis may further comprise identifying a predefined sound scene class wherein, in that sound scene class, sub-parts of the sound scene have predefined characteristics; and establishing index audio clips based on recognized sound sources or groups of sound sources.

In the various embodiments, generating modified audio data comprises executing an algorithm for determining a trajectory and field of listening of the virtual microphone from one sound source or group of sound sources to the next.

In the various embodiments, analysis may further comprise identifying a predefined sound scene class wherein, in that sound scene class, sub-parts of the sound scene have predefined characteristics; and establishing index audio clips based on recognized sound sources or groups of sound sources; and the process of generating a modified audio data comprises executing an algorithm for determining a trajectory and field of view of the virtual microphone from one sound source or group of sound sources to the next, the algorithm further determining at least one parameter selected from the set comprising: the order of the index audio clips to be played; the amount of time for which each index audio clip is to be played; and the nature of the transition between each of the index audio clips.

In the various embodiments, generating a modified audio data may further comprise use of a psychological model of saliency of the sound sources.

The method may further comprise an additional process of performing a selective editing of the recorded sound scene to generate a modified recorded sound scene, the at least one virtual microphone being configurable to move about in the modified recorded sound scene.

In the various embodiments, generating the virtual microphone may further comprise a rendering process of placing the virtual microphone in the soundscape and synthesising the sounds that it would capture in accordance with a model of sound propagation in a three dimensional environment.

In the various embodiments, audio data may be associated with an image data and generating the virtual microphone comprises synchronising the virtual microphone with an image content of the image data.

In the various embodiments, audio data may be associated with image data and generating the virtual microphone comprises synchronising the virtual microphone with an image content of the image data, the modified audio data representing the virtual microphone being used to modify the image content for display in conjunction with the generated virtual microphone.

In the various embodiments, audio data may be associated with an image data and generating the virtual microphone comprises synchronising the virtual microphone with identified characteristics of an image content of the image data.

The various embodiments may further comprise acquiring the audio data representative of the recorded sound scene.

In the various embodiments, the time and space reference frame may be moveable with respect to the recorded sound scene.

In the various embodiments, characterising of audio data may further comprise determining a style parameter for conducting a search process of the audio data for identifying the set of sound sources.

In the various embodiments, characterising may further comprise selecting the time and space reference frame from: a reference frame fixed with respect to the sound scene; and a reference frame which is moveable with respect to the recorded sound scene.

In the various embodiments, the virtual microphone may be controlled to tour the recorded sound scene following a path which is determined as a path which a virtual listener would traverse within the recorded sound scene; and wherein the modified audio data represents sound captured from the virtual microphone from a perspective of the virtual listener.

In the various embodiments, the virtual microphone may be controlled to conduct a virtual tour of the recorded sound scene, in which a path followed by the virtual microphone is determined from an analysis of sound sources which draw an attention of a virtual listener; and the generated modified audio data comprises the sound sources which draw the attention of the virtual listener.

In the various embodiments, the virtual microphone may be controlled to conduct a virtual tour along a path, determined from a set of aesthetic considerations of objects within the recorded sound scene.

In the various embodiments, the virtual microphone may be controlled to follow a virtual tour of the recorded sound scene following a path which is determined as a result of aesthetic considerations of viewable objects in an environment coincident with the recorded sound scene; and wherein the generated modified audio data represents sounds which would be heard by virtual listener following the path.

According to another embodiment, there is provided a method of processing audio data representative of a recorded sound scene, the audio data comprising a set of sound sources each referenced within a spatial reference frame, the method comprising: identifying characteristic sounds associated with each the sound source; selecting individual sound sources according to their identified characteristic sounds; navigating the sound scene to sample the selected individual sound sources; and generating a modified audio data comprising the sampled sounds originating from the selected sound sources.

In the various embodiments, navigating may comprise following a multi-dimensional trajectory within the sound scene.

In the various embodiments, selecting may comprise determining which individual the sound sources exhibits features which are of interest to a human listener in the context of the sound scene; and the navigating the sound scene comprises visiting individual the sound sources which exhibit the features which are of interest to a human listener.

According to another embodiment, there is provided a method of processing audio data comprising: resolving an audio signal into a plurality of constituent sound elements, wherein each the sound element is referenced to a spatial reference frame; defining an observation position within the spatial reference frame; and generating from the constituent sound elements, an audio signal representative of sounds experienced by a virtual observer at the observer position within the spatial reference frame.

In the various embodiments, observer position may be moveable within the spatial reference frame.

In the various embodiments, observer position may follow a three dimensional trajectory with respect to the spatial reference frame.

Embodiments may further comprise resolving an audio signal into constituent sound elements, wherein each the constituent sound element comprises a characteristic sound quality, and (b) a position within a spatial reference frame; defining a trajectory through the spatial reference frame; and generating from the constituent sound elements, an output audio signal which varies in time according to an output of a virtual microphone traversing the trajectory.

According to another embodiment, there is provided a method of processing audio data, the method comprising: acquiring a set of audio data representative of a recorded sound scene; characterising the audio data into a set of sound sources occupying positions within a time and space reference frame; identifying characteristic sounds associated with the sound sources; and generating a modified audio data representing sound captured from at least one virtual microphone configured for moving around the recorded sound scene, wherein the virtual microphone is controlled in accordance with the identified characteristic sounds associated with the sound sources, to conduct a virtual tour of the recorded sound scene.

According to another embodiment, there is provided a computer system comprising an audio data processing means, a data input port and an audio data output port, the audio data processing means being arranged to: receive from the data input port, a set of audio data representative of a recorded sound scene, the audio data characterized into a set of sound sources positioned within a time-space reference frame; perform an analysis of the audio data to identify characteristic sounds associated with the sound sources; generate a set of modified audio data, the modified audio data representing sound captured from at least one virtual microphone configurable to move about the recorded sound scene; and output the modified audio data to the data output port, wherein the virtual microphone is generated in accordance with, and is controlled by, the identified characteristic sounds associated with the sound sources.

In the various embodiments, performing an analysis of the audio data may comprise recognizing a plurality of pre-classified types of sounds by comparing a waveform of a the sound source against a plurality of stored waveforms that are characteristic of the pre-classified types.

In the various embodiments, performing an analysis of the audio data may comprise classifying sounds into sounds of people and non-people sounds.

In the various embodiments, analysis of the sound sources may comprise grouping the sound sources according to at least one criterion selected from the set of: physical proximity of the sound sources; and similarity of the sound sources.

In the various embodiments, the computer system may comprise an algorithm for determining a trajectory of the virtual microphone with respect to the sound sources.

In the various embodiments, the computer system may comprise an algorithm for determining a field of view of the virtual microphone with respect to the sound sources.

In the various embodiments, the computer system may comprise a search algorithm for performing a search procedure for establishing the saliency of the sound sources.

In the various embodiments, the computer system may comprise a search algorithm for performing a search procedure, based at least partly on the saliency of the sound sources, to determine a set of possible virtual microphone trajectories.

In the various embodiments, the computer system may comprise an algorithm for performing a search procedure, based on the saliency of the sound sources, to determine a set of possible virtual microphone trajectories, the search being constrained by at least the allowable duration of a sound source signal output by the generated virtual microphone.

In the various embodiments, generating the modified audio data may comprise a search procedure, based on the saliency of the sound sources, to determine a set of possible virtual microphone trajectories, the search procedure comprising a calculation of: an intrinsic saliency of the sound sources; and at least one selected from the set comprising: a feature based saliency of the sources; and a group saliency of a group of the sound sources.

In the various embodiments, performing an analysis of the audio data may further comprise identifying a predefined sound scene class wherein, in that sound scene class, subparts of the sound scene have predefined characteristics; and establishing index audio clips based on recognised sound sources or groups of sound sources, and the generating the modified audio data comprises executing an algorithm for determining a trajectory and field of view of the virtual microphone from one sound source or group of sound sources to another sound source or group of sound sources.

In the various embodiments, performing an analysis of the audio data further may comprise identifying a predefined sound scene class wherein, in that sound scene class, subparts of the sound scene have predefined characteristics; and establishing index audio clips based on recognized sound sources or groups of sound sources, the generating modified audio data comprising executing an algorithm for determining a trajectory and field of view of the virtual microphone from one sound source or group of sound sources to the next, the algorithm further determining at least one parameter from the set comprising: an order of the index audio clips to be played; an amount of time for which each index audio clip is to be played; and a nature of a transition between each of the index audio clips.

In the various embodiments, generating modified audio may comprise use of a psychological model of saliency of the sound sources.

In the various embodiments, the audio data processing means may be configured to perform a selective editing of the recorded sound scene to generate a modified recorded sound scene, the at least one virtual microphone being configurable to move about therein.

In the various embodiments, generating the virtual microphone may comprise a rendering process of placing the virtual microphone in the soundscape and synthesising the sounds that it would capture in accordance with a model of sound propagation in a three dimensional environment.

In the various embodiments, the audio data may be associated with image data and generating the virtual microphone comprises synchronising the virtual microphone with an image content of the image data, the modified audio data representing the virtual microphone being used to modify the image content for display in conjunction with the generated virtual microphone.

In the various embodiments, the audio data may be associated with an image data and the generating audio data comprises synchronising the virtual microphone with identified characteristics of an image content of the image data.

According to another embodiment, there is provided a computer program stored on a computer-usable medium, the computer program comprising computer readable instructions for causing a computer to execute the functions of: acquiring a set of audio data representative of a recorded sound scene, the audio data characterized into a set of sound sources within a time-space reference frame; using an audio data processing means to perform an analysis of the audio data to identify characteristic sounds associated with the characterized sound sources; and generating, in the audio data processing means, a set of modified audio data for output to an audio-player, the modified audio data representing sound captured from at least one virtual microphone configurable to move about the recorded sound scene, wherein the virtual microphone is generated in accordance with, and thereby controlled by, the identified characteristic sounds associated with the sound sources.

According to another embodiment, there is provided an audio data processing apparatus for processing data representative of a recorded sound scene, the audio data comprising a set of sound sources each referenced within a spatial reference frame, the apparatus comprising: means for identifying characteristic sounds associated with each the sound source; means for selecting individual sound sources according to their identified characteristic sounds; means for navigating the sound scene to sample the selected individual sound sources; and means for generating a modified audio data comprising the sampled sounds.

In the various embodiments, the navigating means may be operable for following a multi-dimensional trajectory within the sound scene.

In the various embodiments, the selecting means may comprise means for determining which individual the sound sources exhibit features which are of interest to a human listener in the context of the sound scene; and the navigating means is operable for visiting individual the sound sources which exhibit the features which are of interest to a human listener.

In the various embodiments, the audio data processing apparatus may comprise a sound source characterisation component for characterising an audio data into a set of sound sources occupying positions within a time and space reference frame; a sound analyser for performing an analysis of the audio data to identify characteristic sounds associated with the sound sources; at least one virtual microphone component, configurable to move about the recorded sound scene; and a modified audio generator component for generating a set of modified audio data representing sound captured from the virtual microphone component, wherein movement of the virtual microphone component in the sound scene is controlled by the identified characteristic sounds associated with the sound sources.

In the various embodiments, the audio data processing apparatus may further comprise a data acquisition component for acquiring the audio data representative of a recorded sound scene.

According to another embodiment, there is provided a method of processing an audio visual data representing a recorded audio-visual scene, the method comprising: characterising the audio data into a set of sound sources, occupying positions within a time and space reference frame; analysing the audio-visual data to obtain visual cues; and generating a modified audio data representing sound captured from at least one virtual microphone configured for moving around the recorded audio-visual scene, wherein the virtual microphone is controlled in accordance with the visual cues arising as a result of the analysis of the audio-visual data to conduct a virtual tour of the recorded audio-visual scene.

According to another embodiment, there is provided an audio-visual data processing apparatus for processing an audio-visual data representing a recorded audio-visual data representing a recorded audio-visual scene, the apparatus comprising: a sound source characterizer for characterizing audio data into a set of sound sources occupying positions within a time and space reference frame; an analysis component for analysing the audio-visual to obtain visual cues; at least one virtual microphone component, configurable to navigate the audio-visual scene; and an audio generator component for generating a set of modified audio data representing sound captured from the virtual microphone component, wherein navigation of the virtual microphone component in the audio-visual scene is controlled in accordance with the visual cues arising as a result of the analysis of the audio-visual data.

The data processing apparatus may further comprise a data acquisition component for acquiring audio-visual data representative of a recorded audio-visual scene.

What is claimed is:

1. A method of processing audio data, said method comprising: characterizing, using a processor, an audio data representative of a recorded sound scene into a set of sound sources occupying positions within a time and space reference frame; analyzing said set of sound sources of the audio data; selecting a subset of sound sources from the set of sound sources of the audio data based on a result of the analysis; determining at least one virtual microphone trajectory using the selected subset of sound sources; and generating a modified audio data representing sound captured from at least one virtual microphone configured for moving about said recorded sound scene, wherein said virtual microphone is controlled in accordance with the at least one virtual microphone trajectory and the selected subset of sound sources, to conduct a virtual tour of said recorded sound scene.

2. The method as claimed in claim 1, comprising:

identifying characteristic sounds associated with said sound sources; and controlling said virtual microphone in accordance with said identified characteristic sounds associated with said sound sources.

3. The method as claimed in claim 1, comprising:

normalising said sound signals captured from the at least one virtual microphone by referencing each of said sound signals to a common maximum signal level; and mapping said sound sources of the audio data to said normalised sound signals.

4. The method as claimed in claim 1, wherein said analysis comprises selecting sound sources which are grouped together within said reference frame.

5. The method as claimed in claim 1, wherein said analysis comprises determining a causality of said sound sources.

6. The method as claimed in claim 1, wherein said analysis comprises recognizing sound sources representing sounds of a similar classification type.

7. The method as claimed in claim 1, wherein said analysis comprises identifying new sounds which first appear in said recorded sound scene and which were not present at an initial beginning time position of said recorded sound scene.

8. The method as claimed in claim 1, wherein said analysis comprises recognizing sound sources which accompany self reference point within said reference frame.

9. The method as claimed in claim 1, wherein said analysis comprises recognizing a plurality of pre-classified types of sounds by comparing a waveform of a said sound source against a plurality of stored waveforms that are characteristic of said pre-classified types.

10. The method as claimed in claim 1, wherein said analysis comprises classifying sounds into sounds of people and non-people sounds.

11. The method as claimed in claim 1, wherein said analysis comprises grouping said sound sources according to at least one criterion selected from the set of:

physical proximity of said sound sources; and similarity of said sound sources.

12. The method as claimed in claim 1, wherein said generating modified audio data comprises executing an algorithm for determining a trajectory of said virtual microphone followed with respect to said sound sources, during said virtual tour.

13. The method as claimed in claim 1, wherein said generating a modified audio data comprises executing an algorithm for determining a field of reception of said virtual microphone with respect to said sound sources.

14. The method as claimed in claim 1, wherein said generating a modified audio data comprises executing a search algorithm comprising a search procedure for establishing a saliency of said sound sources.

15. The method as claimed in claim 1, wherein said generating a modified audio data comprises a search procedure, based at least partly on the saliency of said sound sources, to determine a set of possible virtual microphone trajectories.

16. The method as claimed in claim 1, wherein said generating a modified audio data comprises a search procedure, based on the saliency of said sound sources, to determine a set of possible virtual microphone trajectories, said search being constrained by at least an allowable duration of a sound source signal output by said generated virtual microphone.

17. The method as claimed in claim 1, wherein said generating a modified audio data comprises a search procedure, based on the saliency of said sound sources, to determine a set of possible virtual microphone trajectories, said search procedure comprising a calculation of:

an intrinsic saliency of said sound sources; and at least one selected from the set comprising:

a feature-based saliency of said sources; and a group saliency of a group of said sound sources.

18. The method as claimed in claim 1, wherein said analysis further comprises:

identifying a predefined sound scene class wherein, in that sound scene class, sub-parts of the sound scene have predefined characteristics; and establishing index audio clips based on recognised sound sources or groups of sound sources.

19. The method as claimed in claim 1, wherein said generating modified audio data comprises executing an algorithm for determining a trajectory and field of listening of said virtual microphone from one sound source or group of sound sources to the next.

20. The method as claimed in claim 1, wherein said analysis further comprises:

identifying a predefined sound scene class wherein, in that sound scene class, sub-parts of the sound scene have predefined characteristics; and establishing index audio clips based on recognised sound sources or groups of sound sources; and said process of generating a modified audio data comprises executing an algorithm for determining a trajectory and field of view of said virtual microphone from one sound source or group of sound sources to the next, said algorithm further determining at least one parameter selected from the set comprising:

the order of the index audio clips to be played;

the amount of time for which each index audio clip is to be played; and the nature of the transition between each of said index audio clips.

21. The method as claimed in claim 1, wherein said generating a modified audio data comprises use of a psychological model of saliency of said sound sources.

22. The method as claimed in claim 1, comprising an additional process of performing a selective editing of said recorded sound scene to generate a modified recorded sound scene, said at least one virtual microphone being configurable to move about in said modified recorded sound scene.

23. The method as claimed in claim 1, wherein generating said virtual microphone comprises a rendering process of placing said virtual microphone in said soundscape and synthesising the sounds that it would capture in accordance with a model of sound propagation in a three dimensional environment.

24. The method as claimed in claim 1, wherein said audio data is associated with an image data and generating said virtual microphone comprises synchronising said virtual microphone with an image content of said image data.

25. The method as claimed in claim 1, wherein said audio data is associated with image data and generating said virtual microphone comprises synchronising said virtual microphone with an image content of said image data, said modified audio data representing said virtual microphone being used to modify the image content for display in conjunction with said generated virtual microphone.

26. The method as claimed in claim 1, wherein said audio data is associated with an image data and generating said virtual microphone comprises synchronising said virtual microphone with identified characteristics of an image content of said image data.

27. The method as claimed in claim 1, further comprising acquiring said audio data representative of said recorded sound scene.

28. The method as claimed in claim 1, wherein said time and space reference frame is moveable with respect to said recorded sound scene.

29. The method as claimed in claim 1, wherein said characterising of audio data comprises determining a style parameter for conducting a search process of said audio data for identifying said set of sound sources.

30. The method as claimed in claim 1, wherein said characterising comprises:

selecting said time and space reference frame from:

a reference frame fixed with respect to said sound scene; and a reference flame which is moveable with respect to said recorded sound scene.

31. The method as claimed in claim 1, wherein said virtual microphone is controlled to tour said recorded sound scene following a path which is determined as a path which a virtual listener would traverse within said recorded sound scene; and wherein said modified audio data represents sound captured from said virtual microphone from a perspective of said virtual listener.

32. The method as claimed in claim 1, wherein said virtual microphone is controlled to conduct a virtual tour of said recorded sound scene, in which a path followed by said virtual microphone is determined from an analysis of sound sources which draw an attention of a virtual listener; and said generated modified audio data comprises said sound sources which draw the attention of said virtual listener.

33. The method as claimed in claim 1, wherein the modified audio data includes additional stock sound sources.

34. The method as claimed in claim 1, wherein said virtual microphone is controlled to follow a virtual tour of said recorded sound scene following a path which is determined as a result of aesthetic considerations of viewable objects in an environment coincident with said recorded sound scene; and wherein said generated modified audio data represents sounds which would be heard by virtual listener following said path.

35. A method of processing audio data representative of a recorded sound scene, said audio data comprising a set of sound sources each referenced within a spatial reference frame, said method comprising: identifying, using a processor, characteristic sounds associated with each of said sound sources of the audio data; selecting individual sound sources according to their from the identified characteristic sounds; determining at least one virtual microphone trajectory using the selected individual sound sources; navigating said sound scene to sample said selected individual sound sources based on the virtual microphone trajectory; and generating a modified audio data comprising said sampled sounds originating from said selected sound sources.

36. The method as claimed in claim 35, wherein said navigating comprises following a multi-dimensional trajectory within said sound scene.

37. The method as claimed in claim 35, wherein:

said selecting comprises determining which individual said sound sources exhibits features which are of interest to a human listener in the context of said sound scene; and said navigating said sound scene comprises visiting individual said sound sources which exhibit said features which are of interest to a human listener.

38. A method of processing audio data, the method comprising: resolving, using a processor, an audio signal into a plurality of constituent sound elements, wherein each of said sound elements is referenced to a spatial reference flame; defining an observation position within said spatial reference frame; selecting a set of sound elements from said constituent sound elements in accordance, with the observation position; determining at least one virtual microphone trajectory using the selected set of sound elements; and generating from said selected sound elements and the at least one virtual microphone trajectory, an edited version of the audio signal representative of sounds experienced by a virtual observer at said observer position within said spatial reference frame.

39. The method as claimed in claim 38, wherein said observer position is moveable within said spatial reference frame.

40. The method as claimed in claim 38, wherein said observer position follows a three dimensional trajectory with respect to said spatial reference frame.

41. A method of processing audio data, said method comprising: resolving, using a processor, an audio signal into constituent sound elements, wherein each of said constituent sound elements comprises (a) a characteristic sound quality, and (b) a position within a spatial reference frame; selecting a set of sound elements from the constituent sound elements; defining a virtual microphone trajectory through said spatial reference frame using the selected set of sound elements; and generating from the selected set of sound elements and the defined virtual microphone trajectory, an output audio signal which varies in time.

42. A method of processing audio data, said method comprising: acquiring a set of audio data representative of a recorded sound scene; characterizing, using a processor, said audio data into a set of sound sources occupying positions within a time and space reference frame; identifying characteristic sounds with said of the sound sources; selecting a subset of sound sources from the set of sound sources based on the identified characteristic sounds of the sound sources; determining at least one virtual microphone trajectory using the selected subset of sound sources; and generating a modified audio data representing sound captured from at least one virtual microphone configured for moving around said recorded sound scene, wherein said virtual microphone is controlled in accordance with associated with said the at least one virtual microphone trajectory and the selected subset of the sound sources, to conduct a virtual tour of said recorded sound scene.

43. A computer system comprising an audio data processing means, a data input port and an audio data output port, said audio data processing means being arranged to:

receive from said data input port, a set of audio data representative of a recorded sound scene, said audio data characterised into a set of sound sources positioned within a time-space reference frame;

perform an analysis of said audio data to identify characteristic sounds of the said sound sources;

select a subset of sound sources from the set of sound sources based on the identified characteristic sounds of the sound sources;

determine at least one virtual microphone trajectory using the selected subset of sound sources;

generate a set of modified audio data, said modified audio data representing sound captured from at least one virtual microphone configurable to move about said recorded sound scene; and output said modified audio data to said data output port, wherein said virtual microphone is generated in accordance with, and is controlled by the at least one virtual microphone trajectory and the selected subset of the sound sources.

44. A computer system as claimed in claim 43, wherein said performing an analysis of said audio data comprises recognizing a plurality of pre-classified types of sounds by comparing a waveform of a said sound source against a plurality of stored waveforms that are characteristic of said pre-classified types.

45. A computer system as claimed in claim 43, wherein said performing an analysis of said audio data comprises classifying sounds into sounds of people and non-people sounds.

46. A computer system as claimed in claim 43, wherein said analysis of said sound sources comprises grouping said sound sources according to at least one criterion selected from the set of:

physical proximity of said sound sources; and similarity of said sound sources.

47. A computer system as claimed in claim 43, comprising an algorithm for determining a trajectory of said virtual microphone with respect to said sound sources.

48. A computer system as claimed in claim 43, comprising an algorithm for determining a field of view of said virtual microphone with respect to said sound sources.

49. A computer system as claimed in claim 43, a search algorithm for performing a search procedure for establishing the saliency of said sound sources.

50. A computer system as claimed in claim 43, comprising a search algorithm for performing a search procedure, based at least partly on the saliency of said sound sources, to determine a set of possible virtual microphone trajectories.

51. A computer system as claimed in claim 43, comprising an algorithm for performing a search procedure, based on the saliency of said sound sources, to determine a set of possible virtual microphone trajectories, said search being constrained by at least the allowable duration of a sound source signal output by said generated virtual microphone.

52. A computer system as claimed in claim 43, wherein said generating said modified audio data comprises a search procedure, based on the saliency of said sound sources, to determine a set of possible virtual microphone trajectories, said search procedure comprising a calculation of:

an intrinsic saliency of said sound sources; and at least one selected from the set comprising:

a feature based saliency of said sources; and a group saliency of a group of said sound sources.

53. A computer system as claimed in claim 43, wherein said performing an analysis of said audio data further comprises:

identifying a predefined sound scene class wherein, in that sound scene class, sub-parts of the sound scene have predefined characteristics; and establishing index audio clips based on recognised sound sources or groups of sound sources, and said generating said modified audio data comprises executing an algorithm for determining a trajectory and field of view of said virtual microphone from one sound source or group of sound sources to another sound source or group of sound sources.

54. A computer system as claimed in claim 43, wherein performing an analysis of said audio data further comprises:

identifying a predefined sound scene class wherein, in that sound scene class, sub-parts of the sound scene have predefined characteristics; and establishing index audio clips based on recognised sound sources or groups of sound sources, said generating modified audio data comprising executing an algorithm for determining a trajectory and field of view of said virtual microphone from one sound source or group of sound sources to the next, said algorithm further determining at least one parameter from the set comprising:

an order of the index audio clips to be played;

an amount of time for which each index audio clip is to be played; and a nature of a transition between each of said index audio clips.

55. A computer system as claimed in claim 43, wherein said generating modified audio comprises use of a psychological model of saliency of said sound sources.

56. A computer system as claimed in claim 43, wherein said audio data processing means is configured to perform a selective editing of said recorded sound scene to generate a modified recorded sound scene, said at least one virtual microphone being configurable to move about therein.

57. A computer system as claimed in claim 43, wherein generating said virtual microphone comprises a rendering process of placing said virtual microphone in said soundscape and synthesising the sounds that it would capture in accordance with a model of sound propagation in a three dimensional environment.

58. A computer system as claimed in claim 43, wherein said audio data is associated with image data and generating said virtual microphone comprises synchronising said virtual microphone with an image content of said image data, said modified audio data representing said virtual microphone being used to modify said image content for display in conjunction with said generated virtual microphone.

59. A computer system as claimed in claim 43, wherein said audio data is associated with an image data and said generating audio data comprises synchronising said virtual microphone with identified characteristics of an image content of said image data.

60. A non-transitory computer readable medium upon which a computer program is stored, said computer program comprising: acquiring a set of audio data representative of a recorded sound scene, said audio data characterized into a set of sound sources within a time-space reference frame; using an audio data processing means to perform an analysis of said audio data to identify characteristic sounds of the sound sources; selecting a subset of sound sources from the set of sound sources based on the identified characteristic sounds of the sound sources; determining at least one virtual microphone trajectory using the selected subset of sound sources; and generating, in said audio data processing means, a set of modified audio data for output to an audio player, said modified audio data representing sound captured from at least one virtual microphone configurable to move about said recorded sound scene, wherein said virtual microphone is generated in accordance with, and thereby controlled by, said the at least one virtual microphone trajectory and the selected subset of the sound sources.

61. Audio data processing apparatus for processing data representative of a recorded sound scene, said audio data comprising a set of sound sources each referenced within a spatial reference frame, said apparatus comprising:

means for identifying characteristic sounds associated with each of said sound sources;

means for selecting individual sound sources from the identified characteristic sounds;

means for determining at least one virtual microphone trajectory using the selected individual sound sources;

means for navigating said sound scene to sample said selected individual sound sources based on the at least one virtual microphone trajectory; and means for generating a modified audio data comprising said sampled sounds.

62. The apparatus as claimed in claim 61, wherein said navigating means is operable for following a multi-dimensional trajectory within said sound scene.

63. The apparatus as claimed in claim 61, wherein:

said selecting means comprises means for determining which individual said sound sources exhibit features which are of interest to a human listener in the context of said sound scene; and said navigating means is operable for visiting individual said sound sources which exhibit said features which are of interest to a human listener.

64. Audio data processing apparatus comprising: a memory, said memory storing code for a sound source characterization component for characterizing an audio data into a set of sound sources occupying positions within a time and space reference frame; a sound analyzer for performing an analysis of said audio data to identify characteristic sounds of the sound sources; a sound selecting component for selecting a subset of sound sources from the set of sound sources of the audio data based on the identified characteristic sounds of the sound sources; a trajectory determining component for determining at least one virtual microphone trajectory using the selected subset of sound sources; at least one virtual microphone component, configurable to move about said recorded sound scene; and a modified audio generator component for generating a set of modified audio data representing sound captured from said virtual microphone component; a processor, wherein the processor is configured to control movement of said virtual microphone component in said sound scene associated with said the at least one virtual microphone trajectory and the selected subset of sound sources.

65. The audio data processing apparatus of claim 64, further comprising a data acquisition component for acquiring said audio data representative of a recorded sound scene.

66. A method of processing an audio visual data representing a recorded audio-visual scene, said method comprising: characterizing, using a processor, said audio data into a set of sound sources, occupying positions within a time and space reference frame; analyzing said audio-visual data to obtain visual cues; selecting a subset of sound sources from the set of sound sources based on the visual cues; determining at least one virtual microphone trajectory using the selected subset of sound sources; and generating a modified audio data representing sound captured from at least one virtual microphone configured for moving around said recorded audio-visual scene, wherein said virtual microphone is controlled in accordance with the at least one virtual microphone trajectory and the selected subset of sound sources to conduct a virtual tour of said recorded audio-visual scene.

67. An audio-visual data processing apparatus for processing an audio-visual data representing a recorded audio-visual data representing a recorded audio visual scene, said apparatus comprising: a memory, said memory storing code for a sound source characterizer for characterizing audio data into a set of sound sources occupying positions within a time and space reference frame; an analysis component for analyzing said audio-visual to obtain visual cues; a sound selecting component for selecting a subset of sound sources from the set of sound sources of the audio data based on the visual cues; a trajectory determining component for determining at least one virtual microphone trajectory using the selected subset of sound sources; at least one virtual microphone component, configurable to navigate said audio-visual scene; and an audio generator component for generating a set of modified audio data representing sound captured from said virtual microphone component; a processor, wherein the processor is configured to control navigation of said virtual microphone component in said audio-visual scene in accordance with said visual the at least one virtual microphone trajectory and the selected subset of sound sources.

68. The data processing apparatus as claimed in claim 67, further comprising a data acquisition component for acquiring audio-visual data representative of a recorded audio-visual scene.

* * * * *

UNITED STATES PATENT AND TRADEMARK OFFICE

CERTIFICATE OF CORRECTION

PATENT NO. : 7,876,914 B2
APPLICATION NO. : 11/135556
DATED : January 25, 2011
INVENTOR(S) : David Arthur Grosvenor et al.

It is certified that error appears in the above-identified patent and that said Letters Patent is hereby corrected as shown below:

In column 41, line 30, in Claim 30, delete “flame” and insert -- frame --, therefor.

In column 42, line 17, in Claim 38, delete “flame” and insert -- frame --, therefor.

In column 42, line 20, in Claim 38, delete “accordance,” and insert -- accordance --, therefor.

Signed and Sealed this
Twenty-seventh Day of March, 2012

David J. Kappos

David J. Kappos
*Director of the United States Patent and Trademark Office*